United States Patent [19]

Fredlund et al.

[11] Patent Number: 4,891,631

[45] Date of Patent: Jan. 2, 1990

[54] GRAPHICS DISPLAY SYSTEM

[75] Inventors: John R. Fredlund, Rochester; Raymond E. Wess, Holley, both of N.Y.

[73] Assignee: Eastman Kodak Company, Rochester, N.Y.

[21] Appl. No.: 142,095

[22] Filed: Jan. 11, 1988

[51] Int. Cl.[4] ..... G09G 3/02

[52] U.S. Cl. ..... 340/709

[58] Field of Search ..... 340/706, 709, 799; 358/22, 147, 183

[56] References Cited

U.S. PATENT DOCUMENTS

| | | | |
|---|---|---|---|
| 3,581,290 | 5/1971 | Sugarman | 340/799 |
| 4,069,511 | 1/1978 | Lelke | 364/200 |
| 4,078,249 | 3/1978 | Lelke et al. | 364/200 |
| 4,281,345 | 7/1981 | Warn | 358/183 |
| 4,324,401 | 4/1982 | Stubben et al. | 273/85 |
| 4,367,484 | 1/1983 | Kuroyanagi et al. | 358/22 |
| 4,441,105 | 4/1984 | Van Vliet et al. | 340/750 |
| 4,491,834 | 1/1985 | Oguchi | 340/726 |
| 4,503,427 | 3/1985 | Iida | 340/709 |
| 4,625,202 | 11/1986 | Richmond et al. | 340/709 |
| 4,633,297 | 12/1986 | Skerlos et al. | 358/22 |
| 4,644,401 | 2/1987 | Gaskins | 358/183 |
| 4,660,156 | 4/1987 | Guttag et al. | 364/521 |
| 4,668,947 | 5/1987 | Clarke, Jr. et al. | 340/709 |
| 4,700,181 | 10/1987 | Maine et al. | 340/747 |
| 4,706,074 | 11/1987 | Muhich et al. | 340/709 |
| 4,748,504 | 5/1988 | Ikeda et al. | 358/22 |
| 4,751,502 | 6/1988 | Ishii et al. | 340/709 |
| 4,768,029 | 8/1988 | Burrows | 340/709 |
| 4,768,083 | 8/1988 | Romesburg | 358/22 |

OTHER PUBLICATIONS

I. D. Judd et al., IBM Technical Disclosure Bulletin, "Microprocessor-Controlled Cursors", Oct. 1979, vol. 22, No. 5, pp. 2103-2105.

*Primary Examiner*—Gerald Brigance
*Assistant Examiner*—Richard Hjerpe
*Attorney, Agent, or Firm*—Robert M. Wallace

[57] ABSTRACT

A graphics generator is provided for overlaying changeable graphics data on a video display. The graphics generator is microprocessor controlled, and includes a graphics data positioning circuit which permits the microprocessor to vary the displayed graphics in real-time without itself operating at video rates.

10 Claims, 6 Drawing Sheets

GRAPHICS DISPLAY SYSTEM

FIELD OF THE INVENTION

The present invention relates generally to a graphics display system and more specifically to a graphics generator for interposing pointer/cursor, system status, and other graphics on a video display.

BACKGROUND OF THE INVENTION

In many video systems applications it is desirable to provide a changeable, controllable graphics display for viewing with a video display. Such applications include, for example, a film-to-video player wherein a photographic film is converted to a video signal for display on a video monitor. With such a film-to-video player, it is desirable to provide a graphics capability wherein such graphics icons as pointers and text can be displayed on the monitor with the video display. Such graphics can be used, for example, to highlight or identify a particular subject in the video display, or to provide text relevant to the video display. Many other uses are apparent to those familiar with such video systems.

It is often desirable to provide such graphics under control of a microprocessor, whereby great flexibility can be accorded in the forming and changing of the graphics icons and displays. Different texts, for example, can be programmed to appear with different video displays. Various icons can be displayed, and their positions moved. Further, various graphical displays, such as clocks and control information relevant to the video system itself, can be updated on a periodic basis.

In providing such a microprocessor controlled graphics display, the graphics system must be synchronized for operation with the video monitor—for example in accordance with standard, NTSC video timing. This requires that the graphics system be capable of operating at video speeds, which are often much faster than the speeds available from a microprocessor.

SUMMARY OF THE INVENTION

A principal object of the present invention is to provide a new and improved graphics generator which permits user-controllable, changeable graphics to be displayed on a video display in real time.

Another object of the present invention is to provide a graphics generator for use in a video display system which permits microprocessor control of generated graphics without requiring the microprocessor to run at the video rates.

A further object of the present invention is to provide a graphics generator for use in a video display system which permits microprocessor control of generated graphics while requiring a relatively minimal amount of microprocessor time to provide this graphics control.

Yet another object of the present invention is to provide a graphics generator for use in a video display system which provides for real time display of graphics while having relatively small, economical memory requirements.

in accordance with the present invention, a new and improved graphics generator is provided for use in a video display system, the video display system including a video monitor and means for applying a video signal to the video monitor so as to provide a video display on the video monitor. The graphics generator comprises video timing means for providing a line rate clock signal and a pixel clock signal to synchronize the video signal for display on the video monitor.

A microprocessor is provided configured to provide a memory load clock signal of slower frequency than the pixel clock signal, and position data indicating the line and pixel on the video display at which selected graphical icons are to be displayed.

Graphics memory means are provided for selectively writing in, storing, and reading out graphics data resentative of graphical icons for display on the video monitor.

Graphics positioning means are provided operating in synchronism with said line rate and pixel clock signals for generating an actuating signal at a time determined by the position data.

Addressing means responsive to the microprocessor are provided for generating write addresses to write the digital data into the graphics memory means in synchronism with the load clock signal. This addressing means is further responsive to both the microprocessor and the actuating signal for generating read addresses to read the digital data out of the graphics memory means in synchronism with the pixel clock signal.

Means are provided for applying a graphics signal to display a selected color on the video monitor.

Means responsive to the digital data read from the graphics memory means are provided for selecting the video signal data or the graphics signal for display on the video monitor.

BRIEF DESCRIPTION OF THE DRAWINGS

While the specification concludes with claims defining the features of the invention that are regarded as novel, it is believed that the invention, together with further objects thereof, will be better understood from a consideration of the following description in conjunction with the drawing figures, in which like reference numerals are carried forward, and in which:

DETAILED DESCRIPTION OF THE INVENTION

Figure 1:
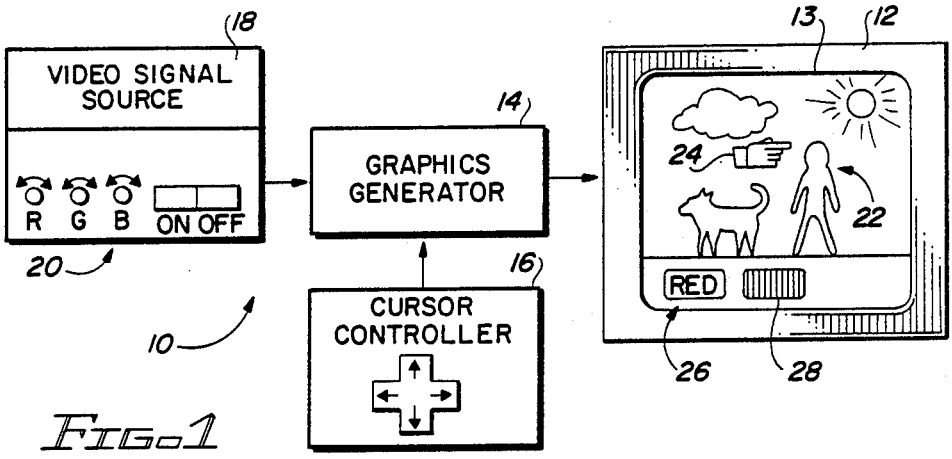
FIG. 1 is a block diagram showing a graphics display system incorporating a graphics generator constructed in accordance with the present invention.

Referring now to the drawings, FIG. 1 shows a video display system 10 constructed in accordance with the present invention. Video display system 10 includes a graphics monitor 12 having a cathode ray tube (CRT) display 13. Monitor 12 comprises a standard color monitor including analog R, G, B or NTSC video inputs.

Connected to monitor 12 is a graphics generator 14, the structure and operation of which is described in detail below. Connected to graphics generator 14 is a cursor controller 16, and a video signal source 18. Cursor controller 16 comprises a conventional cursor position data generator, such as a momentary contact keypad. Video signal source 18 comprises, for example, a film-to-video player of the type shown in U.S. Pat. No. 4,482,924, assigned to the assignee of the present invention. Video signal source 18 includes a control panel 20 providing user-adjustable controls for controlling display 13 of monitor 12. Such controls include, but are not limited to, Red, Green, and Blue color intensity controls, a brightness control, a sharpness control, and a contrast control. Such controls are conventional in the art, and are not described in detail herein.

While the construction and operation of video display system 10 will be described in detail below, such description will be aided by a preliminary understanding of the basic operation of the system. Accordingly, in operation, monitor driver 18 provides a video signal for driving display 13 to produce a color video picture 22. Graphics generator 14 functions to selectively overlay a movable cursor 24, control status graphics 26, 28, or other selected graphics icons on picture 22. As used herein, the terms graphics and icons, when used to describe a display on monitor 12, include text, patterns, and all other generated displays.

Figure 2:
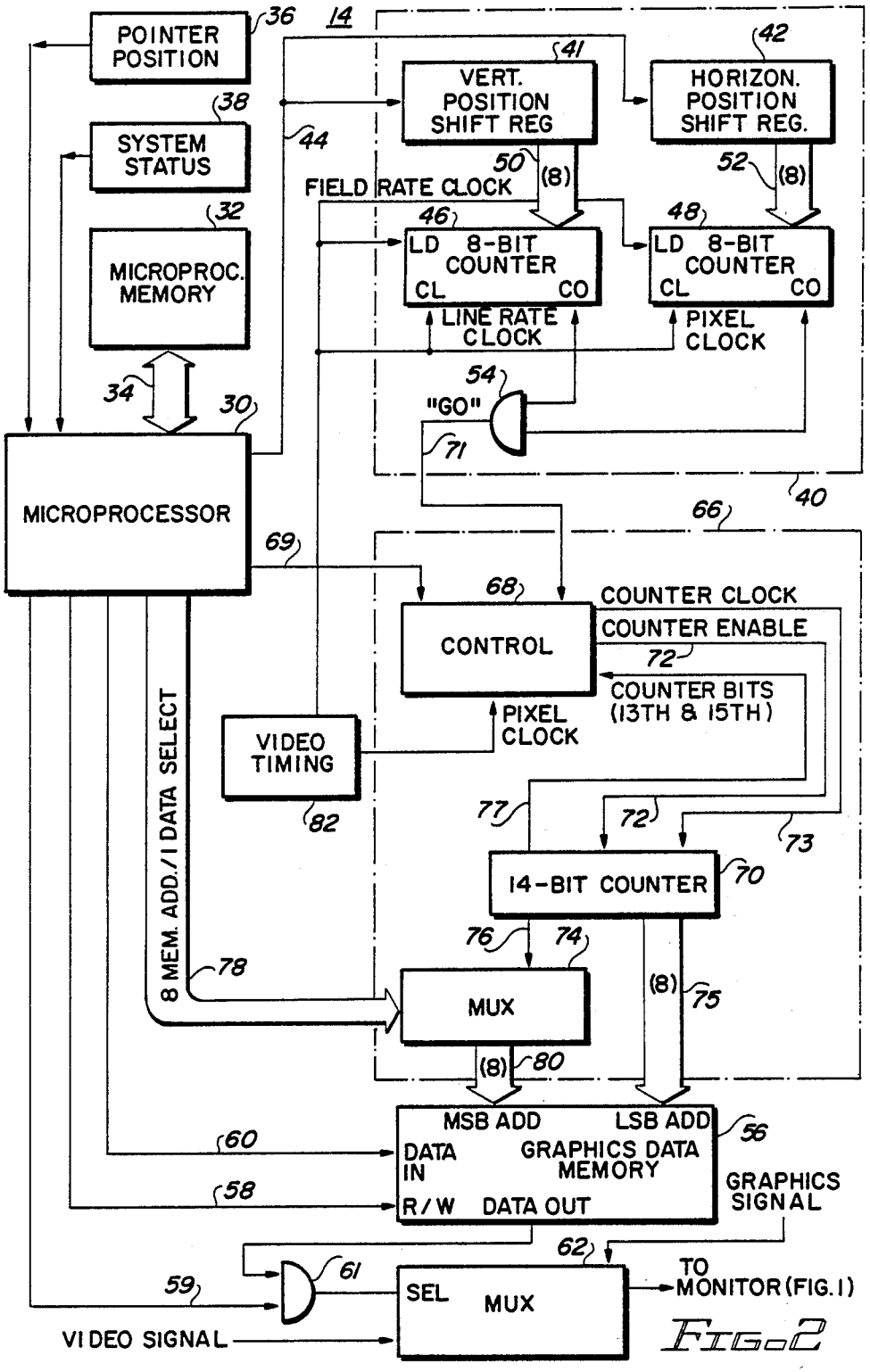
FIG. 2 is a block diagram of the graphics generator of FIG. 1.

Referring now to FIG. 2, graphics generator 14 includes a microprocessor/controller 30 for controlling the operation thereof. Microprocessor 30 comprises, for example, an 8 bit, TTL-compatible, Intel 8031 from Intel Corp. A read/write memory 32, comprising for example an 8K by 8-bit static random access memory (SRAM), is connected to microprocessor 30 by a control signal and data bus 34. Pointer icon position data generated by cursor controller 16 (FIG. 1) is indicated schematically at 36, and system status data from monitor driver 18 (FIG. 1) is indicated schematically at 38.

A graphics positioning circuit 40 includes two 8-bit, vertical and horizontal position shift registers 41, 42, respectively. Shift registers 41, 42 are connected to microprocessor 30 by a control line 44. Circuit 40 further includes two 8-bit counters 46, 48, connected to shift registers 41, 42, by 8-bit data lines 50, 52, respectively. Shift registers 41, 42, counters 46, 48, and the other logic elements set out below, comprise standard, TTL-compatible logic elements. A logic AND gate 54 is connected to the carry-outputs of counters 46, 48.

A second memory 56, which is a graphics data memory preferably comprising a 64K×1-bit static RAM, is connected to microprocessor 30 via a read/write control line 58, and a serial data transfer line 60. The data output line of memory 56 is connected to the input of a logical AND gate 61, the second input of the gate comprising a control line 59 from microprocessor 30. The output of AND gate 61 is connected to the select/control input of a multiplexer (MUX) 62. A first input to MUX 62 comprises a video signal from video signal source 18. A second input of MUX 62 comprises a graphics signal. This graphics signal is selected so as to drive monitor display 13 to a selected white, black, or color level. Microprocessor 30 functions to enable the output of memory 56 at gate 61 via control line 59. Once enabled by microprocessor 30, the output of gate 61 functions to control MUX 62 so as to select the video or graphics signal for application to monitor 12.

An address control circuit 66 is provided for controlling the read/write addressing of memory 56. Circuit 66 includes a control logic circuit 68, the details of which are shown and described with respect to FIG. 3 below. A control and data signal bus 69 connects microprocessor 30 with control logic circuit 68 for communicating control and clock signals thereto, while a signal line 71 connects the control logic circuit with the output of logical AND gate 54. Address control circuit 66 further includes a 14-bit counter 70. Counter 70 has its enable connected to control logic circuit 68 by a signal line 72, its clock connected to the control logic circuit by a signal line 73, and its $13^{th}$ and carry-out ($15^{th}$) bits connected to the control logic circuit by a signal bus 77. The 8 least significant bits of counter 70 are connected to the 8 least significant bit addresses of memory 56 by a signal bus 75, while the 6 most significant bits of the counter are connected to a MUX 74 by a signal bus 76. MUX 74 is connected to microprocessor 30 by a bus 78, so as to selectively provide 8 memory address bits and 1 data select control bit. The output of MUX 74 is connected to the 8 most significant bits of memory 56 by an 8 bit bus 80.

A video timing circuit 82 is provided, the video timing circuit comprising the same circuit used to generate video timing for monitor 12 and video signal source 18. Video timing circuit 82 comprises, for example, a Fairchild 3262 BDC connected with appropriate counters and logical gates. Video timing circuit 82 functions to provide all conventional video timing clocks, including: (1) a field rate clock (2) a line rate clock (a 15.75 Khz clock for timing vertical video position), and (3) a pixel clock (a 5.4 Mhz clock for timing horizontal video position). The line rate clock of video timing circuit 82 is connected to the clock input of counter 46. The pixel rate clock of video timing circuit 82 is connected to the clock input of counter 48, and to control circuit 68. The field rate clock is connected to the load control input of counters 46, 48.

Figure 3:
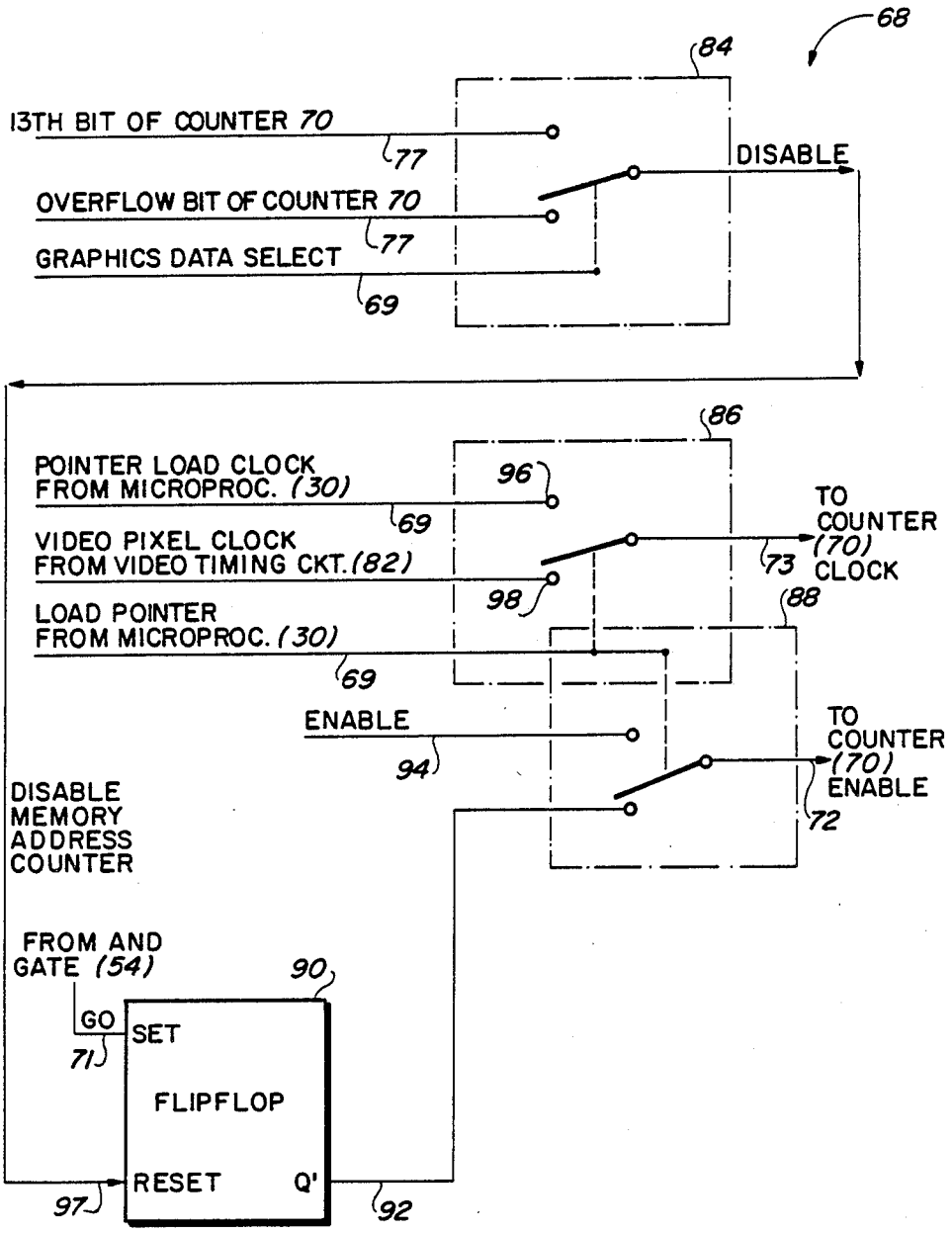
FIG. 3 is a functional block diagram illustrating the operation of the control logic circuit of FIG. 2.

Referring now to FIG. 3, control logic circuit 68 comprises, functionally, three switches indicated at 84, 86, 88, each switch including a controllable wiper positioned for selectively engaging one of two pole terminals. A logical flip-flop 90 is connected between the wiper of switch 84 and a terminal 92 of switch 88.

Examining first switch 88, the wiper thereof is connected to signal line 72 and thus to the enable of counter 70. Wiper control is provided by a "load pointer" control signal generated on signal line 69 by microprocessor 30. When the load pointer control signal is active, the switch wiper is positioned in contact with a terminal 94, the terminal providing a constant, "enable" logic level for enabling counter 70. When the load pointer control signal is inactive, the wiper of switch 88 is positioned to contact the Q′ output 92 of flip-flop 90.

Examining now switch 86, the wiper thereof is connected to signal line 73, and hence to the clock input of counter 70. Control of the wiper position is provided by the load pointer control signal on signal bus 69. When the load pointer control signal is active, the wiper is positioned to contact a terminal 96 so as to provide a "pointer load clock" signal to the clock of counter 70. When the load pointer control signal is inactive, the wiper is positioned to contact a terminal 98 so as to provide the "video pixel clock" signal generated by video timing circuit 82 to counter 70.

Examining switch 84, the wiper thereof is connected to a reset input 97 of flip-flop 90. Wiper control is provided by a "graphics data select" signal generated by microprocessor 30. Switch 84 functions to control the reading of memory 56. When the graphics data select signal is active, the wiper of switch 84 is positioned to contact signal line 74 and hence sense the $13^{th}$ bit of counter 70. When the graphics data select control signal is set inactive, the wiper is positioned to sense the overflow bit (the $15^{th}$ bit) of counter 70.

Turning now to the operation of graphics generator 14 in graphics display system 10, it will be best described in three sections. The first section of the description is keyed to the flow chart in FIG. 4, and will describe graphics data assembly in microprocessor memory 32, loading of the assembled data into memory 56, and loading of the cursor position data into counters 46, 48. The second section, also keyed to the flow chart of FIG. 4, is directed to updating the cursor position and system status data. The third section of the description is keyed to the flow chart of FIG. 5, and is directed to reading the graphics data in memory 56 for display on monitor 12.

DATA ASSEMBLY AND LOADING

Loading of the cursor position data into counters 46, 48, and the graphics data into memory 56, is performed under software control of microprocessor 30.

1. Loading the Graphics Memory

Figure 6:
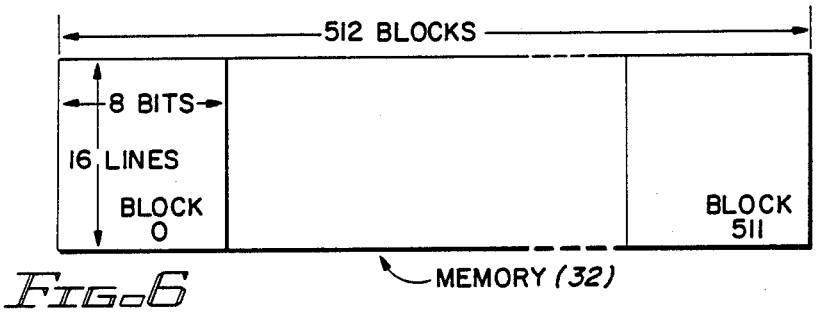
FIG. 6 is a block diagram showing the structure of the data assembled in the microprocessor RAM of FIG. 2.
Figure 4A:
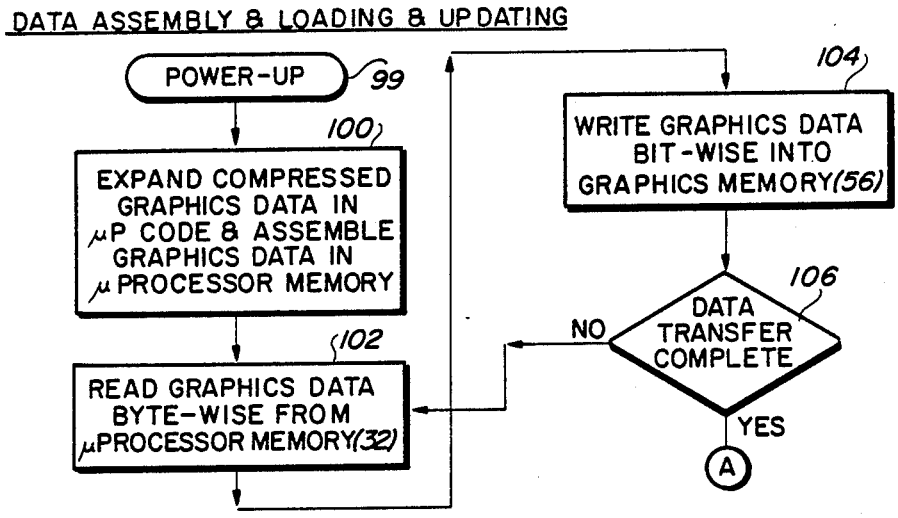
FIGS. 4A–4B constitute a flow chart illustrating the assembly, loading, and updating of the data for the graphics data memory of FIG. 2.
Figure 4B:
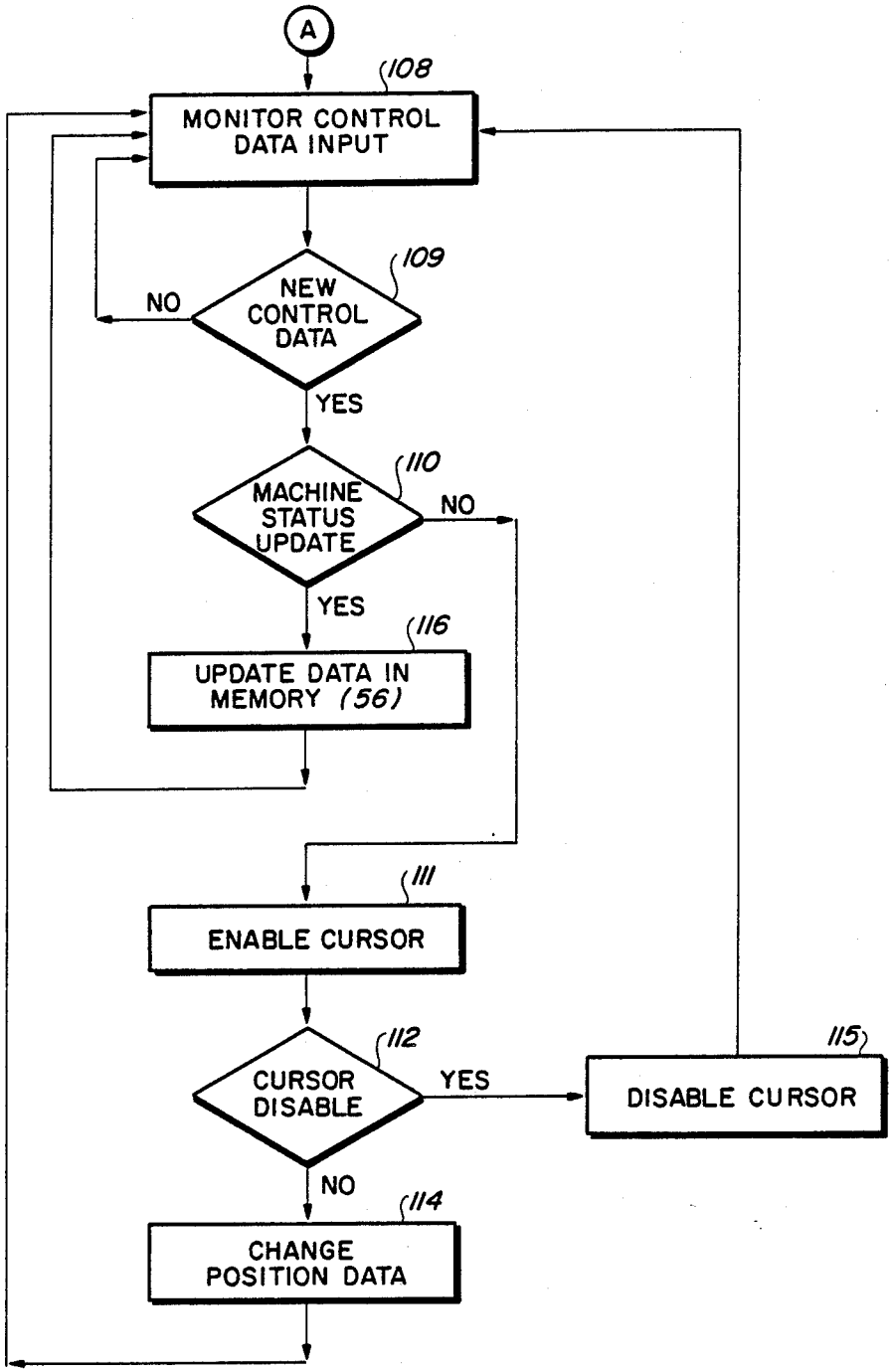

Referring now to FIGS. 4A, 4B, and 6 in addition to those FIGS. described above, upon power up 99 the loading of memory 56 is initiated by assembling data representing desired graphical icons (i.e. cursor and control status displays) in microprocessor memory 32, as shown at block 100 of FIG. 4A. This data is preferably programmed in a compressed format into the Program Memory of microprocessor 30. The compression is accomplished using standard data compression techniques including coding of empty spaces, letters, and fonts, and provides the advantage of requiring a minimal amount of space in the PROM. Subsequent to each power-up of graphics generator 14, this compressed data is expanded, again using the standard techniques described above, and assembled into memory 32 (block 100 of FIG. 4A). Referring specifically to FIG. 6, memory 32 is loaded such that it can be read to provide graphics data in serial format: i.e. as serial pixels in consecutive lines of video. In the embodiment shown, memory 32 is segmented into 512 consecutive blocks, each block containing 16 lines, each line containing an 8-bit byte of serial graphics data.

Figure 7:
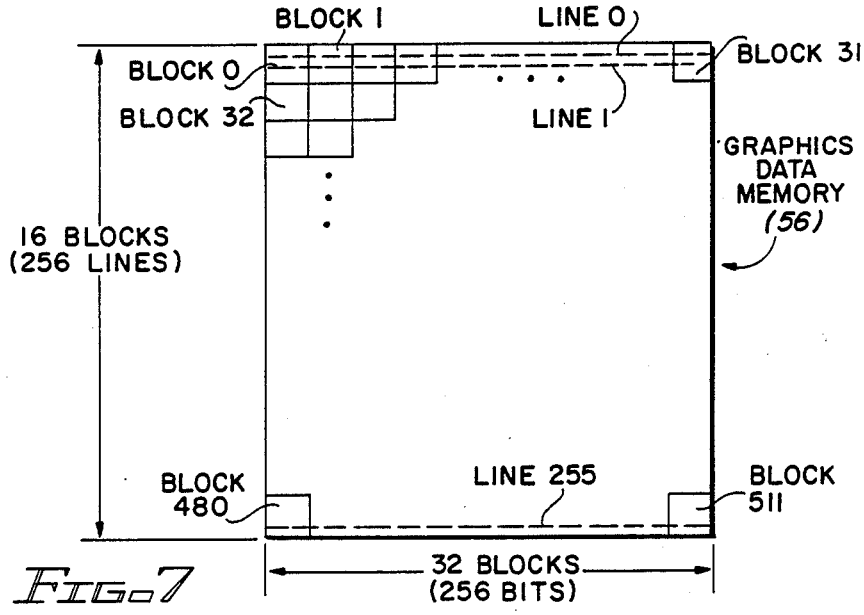
FIG. 7 is a block diagram showing the structure of the data loaded in the graphics data RAM of FIG. 2.

Referring now also to FIG. 7, upon completion of data assembly in memory 32, this graphics data is read out byte-wise (i.e. in 8-bit lines) from memory 32, as indicated by block 102, and written into memory 56 in a serial, bit-wise manner, as indicated by block 104. To initiate this loading of memory 56, switch 86 of control logic circuit 68 is operated to supply a pointer load clock from terminal 96 to counter 70. This pointer load clock operates at a 100 khz clock rate. Switch 88 is operated to enable counter 70 with the enable signal at terminal 94.

Data is now read byte-wise from memory 32 and written serially bit-wise into memory 56. Referring specifically to FIGS. 6 and 7, a first 8-bit byte is read from block 0 of memory 32, and written serially into the first line (line 0) of memory 56. The first byte of block 1 is then read from memory 32 and written serially as the second 8 bits of the first graphics data line in memory 56. This process is repeated until the first byte in block 31 (memory 32) is written into the last 8 bits of the first data line (memory 56). The second bytes of blocks 0–31 (memory 32) likewise from the second line (line 1) of graphics data (memory 56).

Referring to FIG. 2, the addressing for this loading of memory 56 is provided by using the the least significant 7 bits of counter 70 to address the 256 bits in a line. Microprocessor 30 generates 8 address bits, selected through MUX 74, to address the 256 lines in the memory. This transfer of graphics data from memory 32 to memory 56 is performed until all of the data has been transferred, as indicated by block 106 (FIG. 4A).

Figure 8:
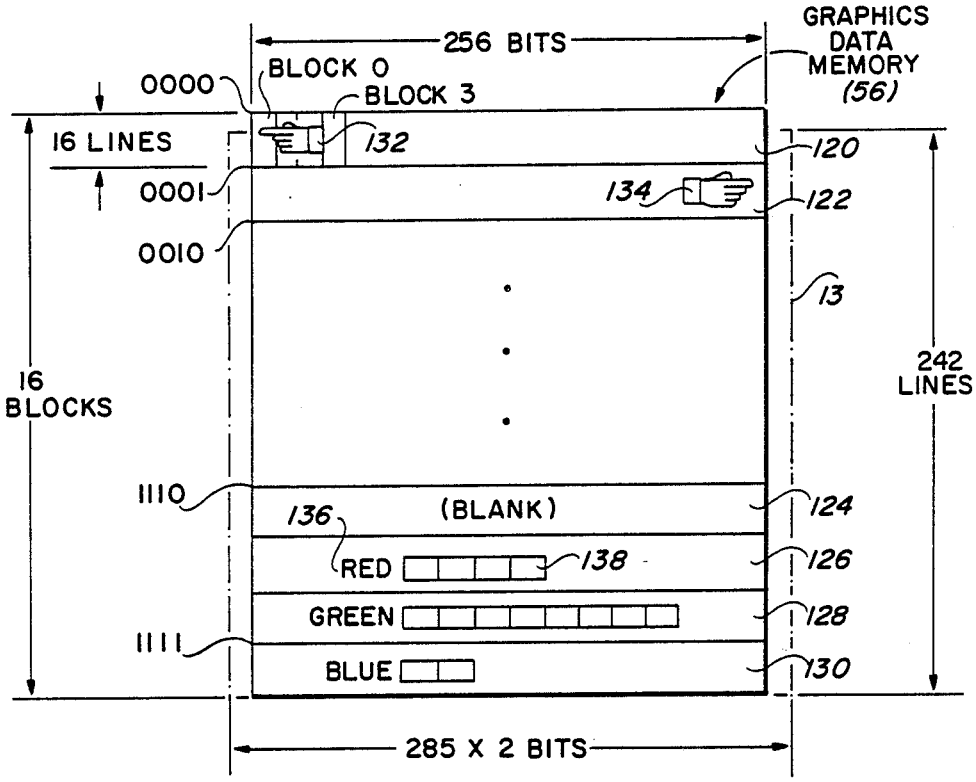
FIG. 8 is a block diagram showing the relationship of the graphics data loaded in the graphics data RAM to a video display.

Referring now to FIG. 8, a block diagram of memory 56 is shown including the video data represented graphically as it would appear if displayed on monitor 12. More specifically, the cursor icon and control status data contained in memory 56 is represented graphically, logical data "1"'s having been replaced with a drawing of the icon represented by the stored data.

In the preferred embodiment of the invention, each graphical icon is contained in a "bar" of memory 56, each bar including 256 bits×16 lines of data. Memory 56 thus contains 16 bars of data, six bars being indicated at 120, 122, 124, 126, 128, 130. Bars 120, 122 contain left- and right-pointing cursors 132, 134, respectively. Cursors 132, 134 are left- and right-justified, respectively, in their respective bars. Each cursor 132, 134 is comprised of four data blocks (FIG. 7). Bar 126 contains a "RED" icon 136, followed by a bar graph icon 138 indicative of the setting of the red color intensity control of monitor driver 18 (FIG. 1). Bars 128 and 130 contain similar graphical data regarding the status of the green and blue color intensity controls. Further shown in FIG. 8 are the four most significant address bits for each bar, which are the same for all 16 lines in each bar. The four most significant address bits of the 16 lines in block 120, for example, comprise "0000". The four significant address bits for bar 122 comprise "0001", with these most significant address bits increasing by "1" for each block to an address of "1111" for the sixteenth block 130. It will be understood that, while only six blocks are shown containing data, the remaining empty blocks can be filled with other desired graphical data (i.e. titles, scenes, error messages, etc . . . ).

In FIG. 8, the contents of memory 56 are shown overlain on the actual video display 13 of monitor 12. In the preferred embodiment of the invention, the pointer pixels in memory 56 are twice as wide as the video pixels. It can be seen that display 13 comprises 570 bits (or 570/2=285 equivalent graphics bits) by 242 lines, and is hence slightly wider and shorter than the graphics data content in memory 56. In the read mode of operation, the addressing of memory 56 is adjusted so as to center the contents of the memory on display 13.

2. Loading the Cursor Position Data

The cursor position data 36 is supplied to microprocessor 30 from cursor controller 16. When the cursor is enabled (by a switch not shown on cursor controller 16), the cursor position data is loaded into shift register 41, 42, and subsequently into counters 46, 48 via the field rate clock.

Updating Data in Memory 56

Referring back to FIG. 4, the control status data (represented in memory 56 by the bar graph icons such as icon 138) and the cursor position data (generated by cursor controller 16 of FIG. 1 and read by microprocessor 30 for loading into registers 41, 42 of FIG. 2) are monitored and updated as necessary. This monitoring, performed by microprocessor 30, is represented by blocks 108, 109, 110.

1. Updating the Cursor Position Data

When microprocessor 30 senses a change in the setting of the system control data, it first determines whether it is a change in the cursor status (enable/disable/position) or machine status (color, brightness, etc . . . ). If it is determined to be a change in the cursor status, the cursor is enabled (re-enabled if currently active) and displayed on the screen 13 (in a manner described in detail below). As long as the cursor is not disabled, its position data is updated once per video field as controlled by the field rate clock via the loading of the position data from registers 41, 42 into counters 46, 48. If there is no change in the cursor position data, the last data loaded into registers 41, 42 is maintained there. These functions are represented by blocks 111 and 112. If the cursor is not being disabled, new position data is being provided and is loaded by microprocessor 30 into shift registers 41, 42, and subsequently clocked by the field rate clock into counters 46, 48. These functions are represented by block 114. Subsequent to the changing of the position data, or the disabling of the cursor (block 115), microprocessor 30 returns to the monitoring mode.

2. Updating Machine Status Data

If the new data is machine status data, the new machine status data is used to update the corresponding graphical icon (eg. icon 138) in memory 56. This process is represented by block 116.

The processes of loading new control status data (block 116) into memory 56 is substantially identical to the data assembly and transfer steps described with respect to blocks 100, 102, 104, 106 above. The only difference between the original assembly and loading described above, and the updating assembly and loading described here, is that in the latter only those data lines which have changed are reassembled and reloaded. All other data is left in memory 56 unchanged. Due to the processing speed of microprocessor 30 and graphics generator 14, an update of one line of the graphics data in memory 56 can be completed in less than one video frame period of 16.7 msec.

Reading the Data to Display Graphics

Figure 5:
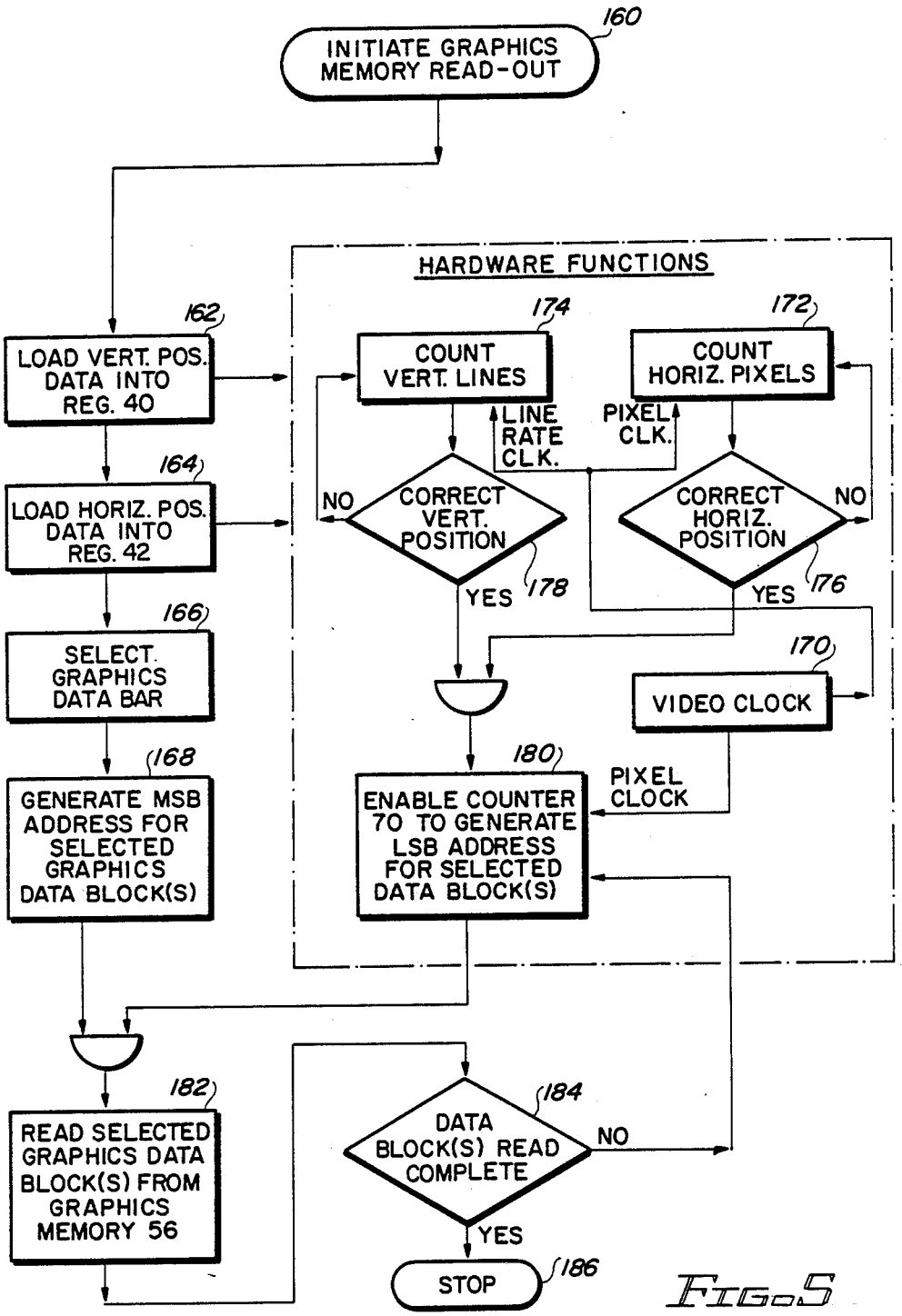
FIG. 5 is a flow chart illustrating the reading of the graphics data memory of FIG. 2.

Referring now to FIG. 5 in addition to those FIGS. described above, the step 160 of initiating a read of memory 56 is controlled by the software of microprocessor 30, and is performed whenever there is graphics data to be displayed on monitor 12. Reading of memory 56 is synchronized by video timing circuit 82 so as to synchronize the display of the graphics data in memory 56 with the video signal provided by video signal source 18. For purposes of explanation, the reading of the data describing cursors 132, 134 will be described first, and the reading of the control status data will follow. For purposes of clarity, several hardware functions have been included, as indicated, in FIG. 5.

1. Displaying the Cursor

It will be assumed that the above described updating has occurred, and the appropriate position data is available in microprocessor 30 for displaying the right and left-pointing cursors 132, 134. For purposes of explanation, the loading of this position data into counters 46, 48, described above, is briefly reviewed below with reference to FIG. 5.

In the embodiment of the invention shown and described herein, left- and right-pointing cursors 132, 134 are provided. Microprocessor 30 operates to select the left-pointing cursor 132 when the cursor is being operated in a left-moving direction of travel, and the right pointing cursor 134 when the cursor is being operated in a right-moving direction of travel. Microprocessor 30 further functions to control the alternating of cursors at the edges of display 13 such that a cursor is not 'lost' off the edge of the display. For purposes of explanation, the reading of memory 56 will be explained with respect to the reading of the right-pointing cursor 134 in data bar 122.

As shown in blocks 160, 162, 164, upon initiating a read of memory 56 (responsive to the appropriate cursor position or machine status control input), microprocessor 30 loads the vertical and horizontal position data relevant for cursor 134 into registers 41, 42, respectively. As discussed above, this position data indicates the line (vertical position data) and pixel (horizontal position data) at which the data stored in the selected region of memory 56 (i.e. in this example cursor data) will begin reading out. Microprocessor 30 then selects data bar 122 (to select the right pointing cursor for this example), and generates the four most significant address bits for that bar. These latter steps are shown in blocks 166, 168. In this example, cursor 134 is selected and the most significant address bits "0001" are generated for data bar 122.

Referring to FIG. 3, the wiper of switch 84 is positioned to sense the 13th bit of counter 70. The wiper of switch 86 is positioned to provide the video clock to counter 70 over signal lead 73. The wiper of switch 88 is positioned to contact terminal 92, the Q' terminal of flip-flop 90.

Referring to FIGS. 2 and 5, the field rate clock loads the data in registers 41, 42 into counters 46, 48, respectively. The operation of graphics generator 14 now operates synchronously with the video display as controlled by video timing circuit 82 and represented by the video clock in block 170. At the beginning of a video frame, counters 46, 48 begin to count upwards from the loaded starting position as shown in blocks 172, 174. Counter 46 is clocked by the line rate clock, and counter 48 is clocked by the pixel clock. When counters 46, 48 reach a count of 255, their respective carry-out bits will go high. When both counters have reached 255, AND gate 54 is made, and the GO signal on output signal line 71 goes active. Referring to FIG. 3, this GO signal sets flip-flop 90, enabling counter 70. These latter operations are indicated in blocks 176, 178, 180 of FIG. 5.

With counter 70 enabled, reading of memory 56 is initiated. Counter 70 is clocked by the horizontal pixel clock generated by video timing circuit 82. MUX 74 is controlled by microprocessor 30 to select the 4 most significant address bits, in this case 0001 as described above, from the microprocessor. The remaining 4 bits of the 8 most significant bits are selected from counter 70. Counter 70 thus provides 12 address bits. As counter 70 counts from 0 to 4095, data bar 122 is read in its entirety from memory 56. When the $13^{th}$ bit of counter 70 goes high, flip-flip 90 is reset, the enable signal on line 72 to counter 70 goes inactive, and the reading of memory 56 is terminated. This reading operation is shown in blocks 182, 184, 186 of FIG. 5.

From a consideration of the above, it will be apparent that the data bar containing the selected, right-pointing cursor icon 134 is read from memory 56. The data bar is read at a time, as determined by the operation of counters 46, 48, that will place cursor 134 at the selected horizontal and vertical position in a video frame to be displayed on monitor display 13. This horizontal/vertical position was, of course, selected by an operator through the manipulation of cursor controller 16 in the manner described above. Due to the respective left and right justification of pointers 132, 134 in memory 56, as the direction of pointer travel is changed, the appropriate cursor appears on display 13 pointing at substantially the same spot as the previous cursor did. From a consideration of the circuit, it will be appreciated that pointer 134 appears one video line lower on display 13 than does pointer 132.

2. Displaying the System Status

The reading of the control status data in bars 124, 126, 128, 130 of memory 56 is performed substantially identically to the reading of the cursor data described above. However, in the preferred embodiment of the invention, whenever one of the Red, Green, or Blue color intensity controls is varied, the status of all three controls is simultaneously displayed. For ease of addressing, data bar 124, including all blanks (i.e. no graphics information), is read to provide a "cushion" between the video display and the graphics. In displaying these four bars of control status data, the position data loaded into registers 41, 42 by microprocessor 30 is always selected to start the read of memory 56 at the beginning of the $96^{th}$ line up from the bottom of display 13. (When displaying only a single bar, the position data would be selected to start the read at the beginning of the $64^{th}$ line up).

To perform this simultaneous display of the status of all three controls, switch 84 of control logic 68 is set to sense the $15^{th}$ bit (i.e. overflow bit) of counter 70. Microprocessor 30 generates the two most significant bits of the address for data bar 124, or address bits "11". MUX 74 is controlled by microprocessor 30 to select only these two most significant bits from the microprocessor, and to select the remaining 6 most significant address bits from counter 70. Counter 70 is thus providing 14 address bits. It will be apparent that, as counter 70 counts from 0 to 16,384, all four of data blocks 124, 126, 128, 130 are read sequentially from memory 56. Thus, all three control status graphics will be displayed at one time. In all other respects, the reading of the control status data is identical that of the cursor data described above.

Referring back to FIG. 2, appropriate apparatus 61, 62 is provided for selecting between the graphics data read from memory 56 and the video data generated by video signal source 18 for display on monitor display 13. This apparatus functions, in the manner described above, to display the graphics signal when graphics data is present in memory 56, and, in the absence of graphics data, to display the video signal data supplied by video signal source 18. Graphics data in memory 56 thus causes graphics icons, the color and intensity of which are selected by the appropriate selection of the graphics signal at the input of MUX 62, to appear overlaid on the video picture displayed on video display 13.

There is thus provided a graphics generator for overlaying graphics icons on a video picture. The graphics generator provides for flexible, microprocessor control of the displayed graphics in real-time, while permitting the use of a relatively slow microprocessor, and a relatively small and economical graphics data memory.

While a preferred embodiment of the invention has been illustrated and described, it will be clear that the invention is not so limited. Numerous modifications, changes, variations, substitutions, and equivalents will occur to those skilled in the art without departing from the scope of the present invention.

The following APPENDIX is a listing of assembly code in the Intel MSC-51 (MCS is a registered trademark of the Intel Corp.) instruction set. This listing, copyrighted by Eastman Kodak Co., includes assembly code defining one method of performing, on an Intel 8031 8-bit microprocessor, the software functions flowcharted and taught herein above.

APPENDIX 1-2

```
        NAME    POINTER_LOAD_ROUTINE

;*************************************************
;*                                               *
;*                                               *
;*                                               *
;*    COPYRIGHT (C) 1988 EASTMAN KODAK COMPANY   *
;*              ALL RIGHTS RESERVED              *
;*                                               *
;*                                               *
;*                                               *
;*                                               *
;*                                               *
;*                                               *
;*                                               *
;*                                               *
;*************************************************


EXTRN   BIT     (LOAD_POINTER,ONE_FOUR,ENPNTR)
EXTRN   DATA    (VPOSIT,HPOSIT)
EXTRN   CODE    (VWAIT,OUT8C)
```

```
PUBLIC  PNTRLD,PPOSIT,NXPLIN,DOIT


PLOAD_CODE      SEGMENT CODE
        RSEG    PLOAD_CODE

DOIT:   MOVX    A,@DPTR                 ;MOVE OUT A BYTE FROM RAM TO POINTER
        RLC     A                       ;MEMORY
        JNC     PCLK7
        SETB    P1.0
PCLK7:  CLR     P1.2
        SETB    P1.2
        CLR     P1.0
        RLC     A
        JNC     PCLK6
        SETB    P1.0
PCLK6:  CLR     P1.2
        SETB    P1.2
        CLR     P1.0
        RLC     A
        JNC     PCLK5
        SETB    P1.0
PCLK5:  CLR     P1.2
        SETB    P1.2
        CLR     P1.0
        RLC     A
        JNC     PCLK4
        SETB    P1.0
PCLK4:  CLR     P1.2
        SETB    P1.2
        CLR     P1.0
        RLC     A
        JNC     PCLK3
        SETB    P1.0
PCLK3:  CLR     P1.2
        SETB    P1.2
        CLR     P1.0
        RLC     A
        JNC     PCLK2
        SETB    P1.0
PCLK2:  CLR     P1.2
        SETB    P1.2
        CLR     P1.0
        RLC     A
        JNC     PCLK1
        SETB    P1.0
PCLK1:  CLR     P1.2
        SETB    P1.2
        CLR     P1.0
        RLC     A
        JNC     PCLK0
        SETB    P1.0
PCLK0:  CLR     P1.2
        SETB    P1.2
        CLR     P1.0
        RET

PNTRLD:
        MOV     VPOSIT,#128             ;SET POINTER POSITION TO MIDDLE
        CALL    PPOSIT                  ;OF SCREEN TO INSURE POINTER
                                        ;MEMORY ADDRESS COUNTER IS
                                        ;SET TO ZERO
        CALL    VWAIT                   ;WAIT FOR VINDEX
        CLR     LOAD_POINTER            ;PULL LOAD_POINTER~ LOW AND
        SETB    ONE_FOUR                ;AND 1BAR/4BAR~ HIGH
        CLR     ENPNTR                  ;AND DISABLE POINTER
        CALL    OUT8C
        MOV     A,#0                    ;INITIALIZE SELECTED LINE
        MOV     DPTR,#8D00H
        MOVX    @DPTR,A
        MOV     VPOSIT,#0               ;INITIALIZE LINE COUNTER
        MOV     HPOSIT,#32              ;INITIALIZE HCOUNTER
```

```
        MOV     DPTR,#5FFFH                     ;INITIALIZE RAM ADDRESS COUNTER


NXBYTE:                                         ;MOVE OUT A BYTE
        INC     DPTR
        MOV     A,DPH                           ;CHECK FOR END OF ROUTINE
        CJNE    A,#80H,DOITNW
        JMP     PLDDUN
DOITNW: CALL    DOIT
        DJNZ    HPOSIT,NXBYTE                   ;CHECK FOR END OF LINE
        CALL    NXPLIN
        JMP     NXBYTE


NXPLIN: MOV     HPOSIT,#32                      ;HOUSEKEEPING AT END OF LINE
        INC     VPOSIT
        MOV     A,VPOSIT
        PUSH    DPH
        PUSH    DPL
        MOV     DPTR,#8D00H
        MOVX    @DPTR,A
        POP     DPL
        POP     DPH
        RET

PLDDUN:
        MOV     VPOSIT,#128                     ;END OF ROUTINE HOUSEKEEPING
        MOV     HPOSIT,#128                     ;SET POINTER POSITION TO CENTER
        CALL    PPOSIT
        SETB    LOAD_POINTER                    ;SET LOAD_POINTER~ HIGH
        CALL    OUT8C
        CLR     A                               ;SELECT POINT LEFT (BAR #0)
        MOV     DPTR,#8D00H
        MOVX    @DPTR,A
        RET


PPOSIT:                         ;FIRST OUT= V msb       LAST OUT= H lsb
        MOV     A,VPOSIT
        MOV     B,#8
        CALL    ROTATE
        MOV     A,HPOSIT
        MOV     B,#8
        CALL    ROTATE
        RET


ROTATE:
        RLC     A
        JNC     NOBIT
        SETB    P1.0
NOBIT:  CLR     P1.3
        SETB    P1.3
        CLR     P1.0
        DJNZ    B,ROTATE
        RET


        END

        NAME    LOAD_RAM_PRIOR_TO_LOADING_POINTER

;*****************************************************
;*                                                   *
;*                                                   *
;*                                                   *
;*    COPYRIGHT (C) 1988 EASTMAN KODAK COMPANY       *
;*              ALL RIGHTS RESERVED                  *
```

```
;*                                                *
;*                                                *
;*                                                *
;*                                                *
;*                                                *
;*                                                *
;*                                                *
;*                                                *
;**************************************************


EXTRN   BIT     (PLUS_MINUS,ONE_FOUR,ENPNTR,LOAD_POINTER)
EXTRN   DATA    (COLOR,VPOSIT,HPOSIT,LINE_MARKER)
EXTRN   CODE    (PPOSIT,VWAIT,NXPLIN,DOIT,OUT8C,ERRORS)
PUBLIC  LDPRAM,LOAD_BAR,SKIPCOUNT

PNTRAM  SEGMENT DATA
        RSEG    PNTRAM

DATUM:          DS      1       ;CONTAINS PRESENT PROGRAM CODE
BLOCKPOINTER:   DS      2       ;KEEPS TRACK OF LINE IN BLOCK BEING FILLED
BLOCKCOUNT:     DS      1       ;KEEPS TRACK OF BLOCK BEING FILLED
BLOCKLINE:      DS      1       ;KEEPS TRACK OF LINE BEING USED TO FILL BLOCK
SKIPCOUNT:      DS      1       ;KEEPS TRACK OF HOW MANY BLOCKS TO SKIP AND
                                ;       IS AN ALL PURPOSE COUNTER USED
                                ;       THROUGHOUT NEXUS PROGRAMS

PTRAM   SEGMENT XDATA
        RSEG    PTRAM

ORDER:  DS      2               ;CONTAINS PRESENT PROGRAM CODE ADDRESS
                                ;FROM WHICH POINTER DATA IS READ
                                ;       ORDER=HIGH BYTE
                                ;       ORDER+1=LOW BYTE


XSEG    AT      6000H           ;RESERVES 8K BYTES FOR POINTER LOADING

        DS      2000H

POINT_RAM       SEGMENT  CODE
        RSEG    POINT_RAM

LDZERO:
        MOV     DPH,BLOCKPOINTER        ;THIS SUBROUTINE OUTPUTS ALL ZEROS
        MOV     DPL,BLOCKPOINTER+1      ;TO THE RAM ADDRESS IN THE BLOCKPOINTER
        MOV     A,#00                   ;AND INCREASES CONTENTS OF
        MOVX    @DPTR,A                 ;THE BLOCKPOINTER BY 32
        CLR     C
        MOV     A,#32
        ADDC    A,DPL
        MOV     BLOCKPOINTER+1,A
        JNC     GOBAK
        INC     BLOCKPOINTER
GOBAK:  RET

GRABIT:
        MOV     DPTR,#ORDER
        MOVX    A,@DPTR
        MOV     B,A
        MOV     DPTR,#ORDER+1
        MOVX    A,@DPTR
        MOV     DPH,B           ;THIS SUBROUTINE INPUTS THE DATA
        MOV     DPL,A           ;IN CODE MEMORY ADDRESS IN "ORDER"
        CLR     A                       ;TO THE ACCUMULATOR AND INCREMENTS
        MOVC    A,@A+DPTR               ;"ORDER"
        MOV     DATUM,A
        INC     DPTR
        MOV     A,DPL
        MOV     B,DPH
        MOV     DPTR,#ORDER+1
        MOVX    @DPTR,A
```

```
        MOV     DPTR,#ORDER
        MOV     A,B
        MOVX    @DPTR,A
        RET

OUTRAM:
        PUSH    DPH                     ;THIS SUBROUTINE OUTPUTS THE CONTENTS
        PUSH    DPL                     ;OF THE ACCUMULATOR TO THE RAM
        MOV     DPH,BLOCKPOINTER        ;ADDRESS IN THE BLOCKPOINTER AND
        MOV     DPL,BLOCKPOINTER+1      ;INCREASES THE CONTENTS OF THE
        MOVX    @DPTR,A                 ;BLOCKPOINTER BY 32
        CLR     C
        MOV     A,DPL
        ADDC    A,#32
        JNC     CONTIN
        INC     DPH
CONTIN: MOV     BLOCKPOINTER,DPH
        MOV     BLOCKPOINTER+1,A
        POP     DPL
        POP     DPH
        RET

LDPRAM:
        MOV     BLOCKCOUNT,#0
        MOV     BLOCKPOINTER,#60H               ;INITIALIZING THE POINTER FOR
                                                ;RAM LOADING
        MOV     DPTR,#ORDER
        MOV     A,#70H
        MOVX    @DPTR,A
        MOV     DPTR,#ORDER+1
        MOV     A,#00H
        MOVX    @DPTR,A
                                        ;INITIALIZE "ORDER"
                                        ;THIS IS THE ADDRESS IN PROGRAM CODE
                                        ;WHICH CONTAINS THE FIRST DATUM FOR
                                        ;POINTER LOADING
BLOKLD:
        MOV     A,BLOCKPOINTER          ;CHECK FOR END OF ROUTINE
        CJNE    A,#80H,LOADEM
        RET
LOADEM: MOV     BLOCKPOINTER+1,BLOCKCOUNT
        CALL    GRABIT
        MOV     A,DATUM
        CLR     C                       ;CHECK FOR OPCODES
        ADDC    A,#128
        JNC     BLOCK
        JMP     DOOPS

BLOCK:                                  ;BLOCK LOADING ROUTINE
        MOV     A,DATUM
        CLR     C
        ADDC    A,#208                  ;CHECK FOR CODE BLOCK NOT IN LETTER
        JNC     LETTER                  ;FORMAT--LETTER FORMAT CODES ARE < 48
        JMP     NONLET
LETTER:                                 ;LETTER FORMAT BLOCK LOADING ROUTINE
        MOV     BLOCKLINE,#11
        CALL    LDZERO
        CALL    LDZERO
        CALL    LDZERO
        MOV     A,DATUM
        CLR     C
        ADDC    A,#233
        JNC     LOWLET
HILET:  MOV     DPH,#78H                ;7800H IS ADDRESS OF LETTER DATA
                                        ;FOR THE LETTER M (CODE #23)
        JMP     MULEM
LOWLET:
        MOV     DPH,#77H                ;7700H IS ADDRESS OF LETTER DATA
        MOV     A,DATUM                 ;FOR THE NUMBER 0 (CODE #0)
MULEM:  MOV     B,#11
        MUL     AB
```

```
        MOV     DPL,A
NXLINE: CLR     A
        MOVC    A,@A+DPTR
        CALL    OUTRAM
        INC     DPTR
        DJNZ    BLOCKLINE,NXLINE
        CALL    LDZERO
        CALL    LDZERO
NXBLOK:
        CALL    FILLED
        JMP     BLOKLD

NONLET:
        MOV     DPH,#79H        ;NON-LETTER FORMAT LOADING ROUTINE
        MOV     BLOCKLINE,#16
        MOV     B,#16
        MUL     AB
        MOV     DPL,A
NEWLIN: CLR     A
        MOVC    A,@A+DPTR
        CALL    OUTRAM
        INC     DPTR
        DJNZ    BLOCKLINE,NEWLIN
        CALL    FILLED
        JMP     BLOKLD

DOOPS:                          ;this code may not be necessary
        MOV     A,DATUM         ;CHECK FOR END OF OPERATION MESSAGE (CODE #255)
        INC     A
        JNZ     NXTCK
        RET
NXTCK:  INC     A               ;CHECK FOR BYTE LOAD COMMAND (CODE #254)
        JNZ     NXTCK2
        JMP     BYTELD
NXTCK2: INC     A               ;CHECK FOR SKIP BLOCK COMMAND (CODE #253)
        JNZ     ERR250
        JMP     SKIP
ERR250:
        MOV     A,#135
        JMP     ERRORS
        RET

BYTELD:
        CALL    GRABIT
        MOV     SKIPCOUNT,DATUM
BYTINT: MOV     BLOCKLINE,#16
NXBYTE: CALL    GRABIT
        MOV     A,DATUM
        CALL    OUTRAM
        DJNZ    BLOCKLINE,NXBYTE
        CALL    FILLED
MORBYT: DJNZ    SKIPCOUNT,BYTINT
        JMP     BLOKLD

SKIP:
        CALL    GRABIT
        MOV     SKIPCOUNT,DATUM
NEWZIP: MOV     BLOCKLINE,#16
ZIP:    CALL    LDZERO
        DJNZ    BLOCKLINE,ZIP
ZIPFIL: CALL    FILLED
MORSKP: DJNZ    SKIPCOUNT,NEWZIP
        JMP     BLOKLD


FILLED: INC     BLOCKCOUNT      ;THE BLOCK IS NOW COMPLETELY FILLED
        DEC     BLOCKPOINTER
        DEC     BLOCKPOINTER
```

```
        INC     BLOCKPOINTER+1
        MOV     A,BLOCKCOUNT
        CJNE    A,#32,MORBLK
        MOV     BLOCKCOUNT,#0    ;END OF THE ROW OF BLOCKS
        MOV     A,#02
        ADD     A,BLOCKPOINTER
        MOV     BLOCKPOINTER,A
        MOV     BLOCKPOINTER+1,#0
MORBLK: RET


LOAD_BAR:
        MOV     BLOCKPOINTER,#60H
        MOV     A,VPOSIT
        MOV     B,#20H
        MUL     AB
        MOV     BLOCKPOINTER+1,A
        MOV     A,B
        ADD     A,BLOCKPOINTER
        MOV     BLOCKPOINTER,A
        PUSH    BLOCKPOINTER
        PUSH    BLOCKPOINTER+1
        MOV     A,HPOSIT
P_OR_M: JB      PLUS_MINUS,PBARS                ;SUBTRACT A BAR
        MOV     A,HPOSIT
        ADD     A,BLOCKPOINTER+1
        MOV     BLOCKPOINTER+1,A
        MOV     BLOCKLINE,#5
MBAR:   CALL    LDZERO
        DJNZ    BLOCKLINE,MBAR
        JMP     BAROUT
PBARS:  DEC     HPOSIT                          ;ADD A BAR
        MOV     A,HPOSIT
        ADD     A,BLOCKPOINTER+1
        MOV     BLOCKPOINTER+1,A
        MOV     BLOCKLINE,#5
PBAR:   MOV     A,#0FEH
        CALL    OUTRAM
        DJNZ    BLOCKLINE,PBAR

BAROUT: CALL    VWAIT
        CLR     LOAD_POINTER            ;PULL LOAD POINTER~ LOW
        SETB    ONE_FOUR                ;SET ONE_FOUR HIGH
;ONE_FOUR must be set high during pointer loading
        CLR     ENPNTR                  ;DISABLE POINTER
        CALL    OUT8C
        PUSH    VPOSIT
        MOV     HPOSIT,#254
        MOV     VPOSIT,#47
        MOV     A,COLOR
        JZ      UNONEW
        MOV     VPOSIT,#79
UNONEW:
        CALL    PPOSIT
        POP     VPOSIT

        MOV     BLOCKLINE,#5
        MOV     HPOSIT,#32
        MOV     A,VPOSIT                ;SELECT APPROPRIATE LINE
        MOV     DPTR,#8D00H
        MOVX    @DPTR,A
        POP     DPL                     ;MOVING ADDRESS OF FIRST BYTE
        POP     DPH                     ;OF ROW WITH BAR TO BE UPDATED
                                        ;TO THE DPTR (THIS ADDRESS WAS
                                        ;PUSHED EARLIER AS BLOCKPOINTER)

        DEC     DPL
NXOUT:  INC     DPTR
        CALL    DOIT
        DJNZ    HPOSIT,NXOUT
        CALL    RESELECT
        CALL    VWAIT
        CALL    DESELECT
```

```
        DJNZ    BLOCKLINE,NXOUT
BAKOUT: MOV     HPOSIT,#254
        MOV     VPOSIT,#48
        MOV     A,COLOR
        JZ      UNONO
        MOV     VPOSIT,#80
UNONO:  CALL    PPOSIT
        CALL    RESELECT
        RET

RESELECT:                                   ;RESELECT DISPLAYED PORTION
        PUSH    DPH
        PUSH    DPL
        MOV     A,LINE_MARKER

;note---LINE_MARKER denotes the position of the row which will be read
;from pointer memory---there are 16 rows, and only the upper 4 bits
;of LINE_MARKER are used to denote the row----the lower 4 bits
;are used only during pointer loading

        MOVX    @DPTR,A
        MOV     A,COLOR
        JZ      PUTEMOUT
        CLR     ONE_FOUR
PUTEMOUT:
        SETB    LOAD_POINTER                ;PULL LOAD POINTER~ HIGH AND
        SETB    ENPNTR                      ;ENABLE POINTER
        CALL    OUT8C
        POP     DPL
        POP     DPH
        RET

DESELECT:                                   ;DISABLE POINTER,
        PUSH    DPH                         ;PULL LOAD POINTER~ LOW, AND
        PUSH    DPL                         ;HOUSEKEEP AT END OF LINE
        MOV     HPOSIT,#32
        INC     VPOSIT
        SETB    ONE_FOUR
        CLR     LOAD_POINTER
        CLR     ENPNTR
        CALL    OUT8C
        MOV     A,VPOSIT                    ;SELECT APPROPRIATE LINE
        MOV     DPTR,#8D00H
        MOVX    @DPTR,A
        POP     DPL
        POP     DPH
        RET

        END
```

```
        NAME    SERIAL_LOAD_CODE

;*************************************************
;*                                               *
;*                                               *
;*                                               *
;*    COPYRIGHT (C) 1988 EASTMAN KODAK COMPANY   *
;*              ALL RIGHTS RESERVED              *
;*                                               *
;*                                               *
;*                                               *
;*                                               *
;*                                               *
;*                                               *
;*                                               *
;*                                               *
;*************************************************

;It may be a good idea to convert this table and the ram loading program
;(pntram.a51) to files using ASCII code.

;253,n----SKIP n BLOCKS
;254,n----LOAD NEXT n BLOCKS WITH NON-LETTER FORMAT BLOCKS

CSEG    AT      7000H

        DB      254,4                                           ;ROW 0
        DB      07FH,0C0H,0C0H,07FH,000H,000H,000H,000H         ;POINT LEFT
        DB      000H,000H,000H,000H,000H,000H,000H,000H
        DB      0FFH,000H,000H,0F8H,0C0H,0C0H,060H,03CH
        DB      030H,030H,018H,00FH,00CH,00CH,006H,003H
        DB      0F8H,01EH,007H,000H,000H,000H,000H,000H
        DB      000H,000H,000H,000H,000H,003H,00FH,0FCH
        DB      07FH,041H,0C1H,041H,041H,041H,041H,041H
        DB      041H,041H,041H,041H,045H,0C1H,041H,07FH
        DB      253,56

        DB      254,4                                           ;ROW 1-BLOCK 28
        DB      0FEH,082H,083H,082H,082H,082H,082H,082H         ;POINT RIGHT
        DB      082H,082H,082H,082H,0A2H,083H,082H,0FEH
        DB      01FH,078H,0E0H,000H,000H,000H,000H,000H
        DB      000H,000H,000H,000H,000H,0C0H,0F0H,03FH
        DB      0FFH,000H,000H,01FH,003H,003H,006H,03CH
        DB      00CH,00CH,018H,0F0H,030H,030H,060H,0C0H
        DB      0FEH,003H,003H,0FEH,000H,000H,000H,000H
        DB      000H,000H,000H,000H,000H,000H,000H,000H
        DB      253,6

        DB      254,6                                           ;ROW 2
        DB      0F0H,0F0H,0F0H,060H,061H,067H,07EH,07CH         ;Kodak
        DB      07EH,077H,063H,061H,060H,0F1H,0F1H,0F1H
        DB      0F0H,0F0H,0F0H,060H,0E0H,080H,000H,001H
        DB      003H,007H,086H,0C6H,0E6H,0F7H,0F3H,0F1H
        DB      000H,000H,000H,000H,000H,000H,000H,0C1H
        DB      0E3H,077H,036H,036H,036H,077H,0E3H,0C1H
        DB      070H,070H,030H,030H,030H,030H,030H,0F1H
        DB      0F3H,032H,030H,031H,033H,033H,0F3H,0D1H
        DB      003H,003H,001H,001H,001H,001H,001H,0E1H
        DB      0F1H,031H,0F1H,0F1H,0B1H,031H,0FBH,0DBH
        DB      080H,080H,080H,080H,080H,080H,080H,09CH
        DB      09CH,0B8H,0F0H,0F0H,0B8H,098H,09CH,09CH
        DB      10,32,19,14,15,25,10,19,23,11,17,19,24,17       ;VIDEO IMAGING
        DB      253,6
```

```
        ;ELECTRONIC PHOTOGRAPHY DIVISION

DB      15,22,15,13,30,28,25,24,19,13,10,26,18,25,30,25
DB      17,28,11,26,18,35,10,14,19,32,19,29,19,25,24,10

        ;MERRY CHRISTMAS

DB      253,8
DB      23,15,28,28,35,10,13,18,28,19,29,30,23,11,29
DB      253,9

        ;THE MAXIMUM NUMBER OF CHARACTERS

DB      30,18,15,10,23,11,34,19,23,31,23,10,24,31,23,12
DB      15,28,10,25,16,10,13,18,11,28,11,13,30,15,28,29

        ; WHICH MAY BE DISPLAYED IS 128.

DB      10,33,18,19,13,18,10,23,11,35,10,12,15,10,14,19
DB      29,26,22,11,35,15,14,10,19,29,10,01,02,08,37,10

        ; THE FORMAT OF THIS DISPLAY IS

DB      10,30,18,15,10,16,25,28,23,11,30,10,25,16,10,30
DB      18,19,29,10,14,19,29,26,22,11,35,10,19,29,10,10

        ; 4 ROWS OF 32 CHARACTERS EACH.

DB      10,04,10,28,25,33,29,10,25,16,10,03,02,10,13,18
DB      11,28,11,13,30,15,28,29,10,15,11,13,18,37,10,10

DB      12,28,19,17,18,30,24,15,29,29,10,48,49,50,51,50 ;BRIGHTNESS-R8
DB      52,50,53,50,54,55,56,57,58,57,59,57,60,57,61,62

DB      10,10,13,25,24,30,28,11,29,30,10,48,49,50,51,50 ;CONTRAST-R9
DB      52,50,53,50,54,55,56,57,58,57,59,57,60,57,61,62

DB      29,11,30,31,28,11,30,19,25,24,10,48,49,50,51,50 ;SATURATION-R1C
DB      52,50,53,50,54,55,56,57,58,57,59,57,60,57,61,62

DB      10,29,18,11,28,26,24,15,29,29,10,48,49,50,51,50 ;SHARPNESS-R11
DB      52,50,53,50,54,55,56,57,58,57,59,57,60,57,61,62

DB      253,32                                          ;SKIP ROW 12

DB      253,7,28,15,14,10,48,49,50,51,50                ;RED-R13
DB      52,50,53,50,54,55,56,57,58,57,59,57,60,57,61,62

DB      253,5,17,28,15,15,24,10,48,49,50,51,50          ;GREEN-R14
DB      52,50,53,50,54,55,56,57,58,57,59,57,60,57,61,62

DB      253,6,12,22,31,15,10,48,49,50,51,50             ;BLUE-R15
DB      52,50,53,50,54,55,56,57,58,57,59,57,60,57,61,62

END
```

```
;*************************************************
;*                                               *
;*                                               *
;*                                               *
;*    COPYRIGHT (C) 1988 EASTMAN KODAK COMPANY   *
;*              ALL RIGHTS RESERVED              *
;*                                               *
;*                                               *
;*                                               *
;*                                               *
;*                                               *
;*                                               *
;*                                               *
;*                                               *
;*************************************************


CSEG    AT      7700H

        DB      038H,07CH,0EEH,0C6H,0C6H,0C6H,0C6H,0C6H,0EEH,07CH,038H  ;0
        DB      018H,038H,078H,018H,018H,018H,018H,018H,018H,07EH,07EH  ;1
        DB      07CH,0FEH,0C6H,00EH,00CH,01CH,018H,038H,070H,0FEH,0FEH  ;2
        DB      07CH,0FEH,0C6H,006H,00EH,00EH,006H,006H,0C6H,0FEH,07CH  ;3
        DB      0C6H,0C6H,0C6H,0C6H,0FEH,0FEH,006H,006H,006H,006H,006H  ;4
        DB      0FEH,0FEH,0C0H,0C0H,0F8H,0FCH,00EH,006H,0CEH,0FCH,078H  ;5
        DB      038H,078H,0E0H,0C0H,0FCH,0FEH,0C6H,0C6H,0C6H,0FEH,07CH  ;6
        DB      0FEH,0FEH,0C6H,00EH,00CH,01CH,018H,038H,030H,030H,030H  ;7
        DB      07CH,0FEH,0C6H,0EEH,07CH,0FEH,0C6H,0C6H,0C6H,0FEH,07CH  ;8
        DB      07CH,0FEH,0C6H,0C6H,0FEH,07EH,006H,006H,01CH,018H,018H  ;9
        DB      000H,000H,000H,000H,000H,000H,000H,000H,000H,000H,000H;SPACE-1(
        DB      038H,07CH,0EEH,0C6H,0FEH,0FEH,0C6H,0C6H,0C6H,0C6H,0C6H  ;A-11
        DB      0F8H,0FCH,0CCH,0CCH,0F8H,0FCH,0C6H,0C6H,0C6H,0FEH,0FCH  ;B-12
        DB      07CH,0FEH,0C6H,0C0H,0C0H,0C0H,0C0H,0C0H,0C6H,0FEH,07CH  ;C-13
        DB      0F8H,0FCH,0CEH,0C6H,0C6H,0C6H,0C6H,0C6H,0CEH,0FCH,0F8H  ;D-14
        DB      0FEH,0FEH,0C0H,0C0H,0F0H,0F0H,0C0H,0C0H,0C0H,0FEH,0FEH  ;E-15
        DB      0FEH,0FEH,0C0H,0C0H,0F0H,0F0H,0C0H,0C0H,0C0H,0C0H,0C0H  ;F-16
        DB      07CH,0FEH,0C6H,0C0H,0CEH,0CEH,0C6H,0C6H,0C6H,0FEH,07CH  ;G-17
        DB      0C6H,0C6H,0C6H,0C6H,0FEH,0FEH,0C6H,0C6H,0C6H,0C6H,0C6H  ;H-18
        DB      07EH,07EH,018H,018H,018H,018H,018H,018H,018H,07EH,07EH  ;I-19
        DB      01EH,01EH,00CH,00CH,00CH,00CH,00CH,0CCH,0FCH,078H,030H  ;J-20
        DB      0C6H,0CEH,0DCH,0F8H,0F0H,0F8H,0DCH,0CEH,0C6H,0C6H,0C6H  ;K-21
        DB      0C0H,0C0H,0C0H,0C0H,0C0H,0C0H,0C0H,0C0H,0C0H,0FEH,0FEH  ;L-22


CSEG    AT      7800H

        DB      082H,0C6H,0EEH,0FEH,0FEH,0D6H,0C6H,0C6H,0C6H,0C6H,0C6H  ;M-23
        DB      0C6H,0E6H,0E6H,0F6H,0F6H,0FEH,0DEH,0DEH,0CEH,0CEH,0C6H  ;N-24
        DB      07CH,0FEH,0C6H,0C6H,0C6H,0C6H,0C6H,0C6H,0C6H,0FEH,07CH  ;O-25
        DB      0F8H,0FCH,0CEH,0CEH,0FCH,0F8H,0C0H,0C0H,0C0H,0C0H,0C0H  ;P-26
        DB      07CH,0FEH,0C6H,0C6H,0C6H,0C6H,0C6H,0C6H,0CEH,0FCH,07EH,006H  ;Q-27
        DB      0F8H,0FCH,0CEH,0CEH,0FCH,0F8H,0DCH,0CCH,0CEH,0C6H,0C6H  ;R-28
        DB      03CH,07EH,0E6H,0C0H,0F0H,03CH,00EH,0C6H,0EEH,07CH,038H  ;S-29
        DB      07EH,07EH,018H,018H,018H,018H,018H,018H,018H,018H,018H  ;T-30
        DB      0C6H,0C6H,0C6H,0C6H,0C6H,0C6H,0C6H,0C6H,0C6H,0FEH,07CH  ;U-31
        DB      0C6H,0C6H,0C6H,0C6H,0C6H,0C6H,0EEH,06CH,07CH,038H,038H  ;V-32
        DB      0C6H,0C6H,0C6H,0D6H,0FEH,0FEH,07CH,06CH,06CH,028H,028H  ;W-33
        DB      0C6H,0C6H,06CH,06CH,038H,038H,038H,06CH,06CH,0C6H,0C6H  ;X-34
        DB      066H,066H,066H,07EH,03CH,018H,018H,018H,018H,018H,018H  ;Y-35
        DB      0FEH,0FEH,006H,00EH,01CH,038H,070H,0E0H,0C0H,0FEH,0FEH  ;Z-36
        DB      000H,000H,000H,000H,000H,000H,000H,000H,000H,0C0H,0C0H  ;.-37

CSEG    AT      7900H

        DB      000H,000H,000H,000H,000H,000H,000H,000H         ;BAR(48)
        DB      000H,0FEH,0FEH,0FEH,0FEH,0FEH,000H,000H

        DB      000H,010H,020H,040H,080H,040H,020H,010H         ; < (49)
        DB      000H,0FEH,0FEH,0FEH,0FEH,0FEH,000H,000H
```

```
DB      000H,000H,000H,000H,00EH,000H,000H,000H          ;-(50)
DB      000H,0FEH,0FEH,0FEH,0FEH,0FEH,000H,000H

DB      000H,0A0H,0A0H,0E0H,020H,020H,020H,000H          ;4 w BAR(51)
DB      000H,0FEH,0FEH,0FEH,0FEH,0FEH,000H,000H

DB      000H,0E0H,020H,060H,020H,020H,0E0H,000H          ;3 w BAR(52)
DB      000H,0FEH,0FEH,0FEH,0FEH,0FEH,000H,000H

DB      000H,0E0H,020H,020H,0E0H,080H,0E0H,000H          ;2 w BAR(53)
DB      000H,0FEH,0FEH,0FEH,0FEH,0FEH,000H,000H

DB      000H,040H,0C0H,040H,040H,040H,0E0H,000H          ;1 w BAR(54)
DB      000H,0FEH,0FEH,0FEH,0FEH,0FEH,000H,000H

DB      000H,001H,002H,002H,002H,002H,001H,000H          ;LEFTHALF 0(55)
DB      000H,0FEH,0FEH,0FEH,0FEH,0FEH,000H,000H

DB      000H,080H,040H,040H,040H,040H,080H,000H          ;RIGHTHALF 0(56
DB      000H,000H,000H,000H,000H,000H,000H,000H

DB      000H,000H,000H,004H,00EH,004H,000H,000H          ;+(57)
DB      000H,000H,000H,000H,000H,000H,000H,000H

DB      000H,040H,0C0H,040H,040H,040H,0E0H,000H          ;1 w no BAR(58)
DB      000H,000H,000H,000H,000H,000H,000H,000H

DB      000H,0E0H,020H,020H,0E0H,080H,0E0H,000H          ;2 w no BAR(59)
DB      000H,000H,000H,000H,000H,000H,000H,000H

DB      000H,0E0H,020H,060H,020H,020H,0E0H,000H          ;3 w no BAR(60)
DB      000H,000H,000H,000H,000H,000H,000H,000H

DB      000H,0A0H,0A0H,0E0H,020H,020H,020H,000H          ;4 w no BAR(61)
DB      000H,000H,000H,000H,000H,000H,000H,000H

DB      000H,010H,008H,004H,002H,004H,008H,010H          ; > (62)
DB      000H,000H,000H,000H,000H,000H,000H,000H

END

        NAME    POINTER_AND_GRAPHICS_CONTROL

;*****************************************************
;*                                                   *
;*                                                   *
;*                                                   *
;*    COPYRIGHT (C) 1988 EASTMAN KODAK COMPANY       *
;*              ALL RIGHTS RESERVED                  *
;*                                                   *
;*                                                   *
;*                                                   *
;*                                                   *
;*                                                   *
;*                                                   *
;*                                                   *
;*                                                   *
;*****************************************************

EXTRN   BIT     (VMARK,SCAN_B,CRSR_B,ONE_FOUR,LOAD_POINTER,ENPNTR,POS_NEG)
EXTRN   DATA    (LPAGE,BRITE_STATUS,CONT_STATUS,SAT_STATUS,SKIPCOUNT,RSP)
EXTRN   DATA    (SHARP_STATUS,RED_STATUS,GREEN_STATUS,BLUE_STATUS,COLOR,OFFSET
EXTRN   DATA    (CCA_FUNCTION,POSTER_MASK)
EXTRN   CODE    (PPOSIT,LOAD_BAR,VWAIT,COLORS,SETSTP,SETLUT,DISPLY)
EXTRN   CODE    (APEROP,APERCL,SET_NOMINAL_LUTS,SETLUT_W_SELECTED_OFFSET)
```

```
EXTRN   CODE    (CHANGE_MATRIX,CHANGE_EDGE_ENHANCEMENT,CHANGE_CONTRAST)
EXTRN   CODE    (GET_CORNER_PIXELS,GET_MIDCOLUMN_DATA,OUT8C,LOAD_ONECOLOR_LUTS
EXTRN   CODE    (SLOAD,KEY_SCAN,KEY_DOWN_TEST,FADE_OUT,CALC_N_MOVE,LDLUT)
EXTRN   CODE    (CHANGE_CORING,CHANGE_OFFSETS,CHRISTMAS,COLORBAR,LARRYBAR)
EXTRN   XDATA   (SERIAL_REGISTERS,ROTATION_POINT)

PUBLIC  PLEFT,PRIGHT,PUP,PDOWN,PUP_LEFT,PUP_RIGHT,PDOWN_LEFT,PDOWN_RIGHT
PUBLIC  PEN,PDIS,VPOSIT,HPOSIT,KVI,WAYNE,RANDY
PUBLIC  PBRITE,MBRITE,PSAT,MSAT,PCONT,MCONT,PSHARP,MSHARP,ABRITE
PUBLIC  PRED,MRED,PGREEN,MGREEN,PBLUE,MBLUE,ACOLOR,INC_LUT_PAGE
PUBLIC  COD904,COD905,COD906,COD907,COD908,COD909,COD910
PUBLIC  COD911,COD912,COD913,COD914,COD915,COD916,COD917,COD918,COD919,COD920
PUBLIC  COD921,COD922,COD923,COD924,COD925,COD926,COD927,COD928,COD929,COD930
PUBLIC  COD931,COD932,COD933,COD934,COD935,COD936,COD937,COD938,COD939,COD940
PUBLIC  COD941,COD942,COD943,COD944,COD945,COD946,COD947,COD948,COD949,COD950
PUBLIC  COD951,COD952
PUBLIC  LINE_MARKER,PLUS_MINUS,VCOUNT,IS_POINTER_POINTING

CNTROL_BITS     SEGMENT BIT
        RSEG    CNTROL_BITS

PLUS_MINUS:     DBIT    1

CNTROL_DATA     SEGMENT DATA
        RSEG    CNTROL_DATA

VPOSIT:         DS      1
HPOSIT:         DS      1


CNTROL_CODE     SEGMENT CODE
        RSEG    CNTROL_CODE

;SPECIAL 900 CODES----
;
;                       900---KODAK VIDEO IMAGING
;                       901---ELECTRONIC PHOTOGRAPHY DIVISION
;                       902---MERRY CHRISTMAS ON RED AND GREEN
;                       903---INCREMENT LUT PAGE
;                       904---DECREMENT LUT PAGE
;                       905---LOAD SELECTED LUT PAGE WITH A LINEAR RAMP
;                       906---LOAD SELECTED LUT PAGE WITH A 16-STEP RAMP
;                       907---KVI HORIZONTAL WRAPAROUND
;                       908---KVI HORIZONTAL AND VERTICAL BOUNCE
;                       909---LOAD SELECTED LUT PAGE WITH NOMINAL VALUES
;                                (NO OFFSETS IN LUT)
;                       910---LOAD SELECTED LUT PAGE WITH NOMINAL VALUES
;                               (BLUE OFFSET IN LUT= +50 FROM NO OFFSET)
;                       911---ROTATE THROUGH CORING SETTINGS (0,1,2,3)
;                       912---LOAD SELECTED LUT PAGE WITH A 7-BIT LINEAR RAMP
;                       913---DISPLAY STATUS INFORMATION
;                       914---CALL GET_CORNER_PIXELS
;                       915---MAX VIDEO-GREEN MIDCOLUMN 5
;                       916---MIN VIDEO-GREEN MIDCOLUMN 5
;                       917---KVI ON BLUE
;                       918---COLORBARS
;                       919---SCROLL THROUGH POINTER MEMORY
;                       920---ROTATE THROUGH n-BIT RESOLUTIONS
;                       921---ONE BIT RESOLUTION
;                       922---TWO BIT RESOLUTION
;                       923---THREE BIT RESOLUTION
;                       924---FOUR BIT RESOLUTION
;                       925---FIVE BIT RESOLUTION
;                       926---SIX BIT RESOLUTION
;                       927---SEVEN BIT RESOLUTION
;                       928---EIGHT BIT RESOLUTION
;                       929---POS
;                       930---NEG
```

```
;                       931---ZERO MATRIX COEFFICIENTS
;                       932---LARRYBAR
;                       933---FADE_OUT
;                       934---INCREASE POINT OF ROTATION FOR CONTRAST CHANGE
;                       935---DECREASE POINT OF ROTATION FOR CONTRAST CHANGE


KVI:                                        ;CALL WITH CODE 900
        CALL    IS_POINTER_POINTING
        MOV     A,#32                       ;SELECT KODAK VIDEO IMAGING
        MOV     DPTR,#8D00H
        MOVX    @DPTR,A
        MOV     HPOSIT,#254                 ;SET DISPLAY POSITION
        MOV     VPOSIT,#128
        CALL    VWAIT
        CALL    PDIS
        CALL    PPOSIT
        SETB    ENPNTR
        SETB    ONE_FOUR
        CALL    OUT8C           ;ENABLE POINTER, ONE BAR VISIBLE
        RET

WAYNE:
        CALL    IS_POINTER_POINTING         ;CALL WITH CODE 901
        MOV     A,#48                       ;SELECT ELECTRONIC PHOTOGRAPY DIVISION
        MOV     DPTR,#8D00H
        MOVX    @DPTR,A
        MOV     HPOSIT,#254                 ;SET DISPLAY POSITION
        MOV     VPOSIT,#128
        CALL    VWAIT
        CALL    PDIS
        CALL    PPOSIT
        SETB    ENPNTR
        SETB    ONE_FOUR
        CALL    OUT8C           ;ENABLE POINTER, ONE BAR VISIBLE
        RET

RANDY:                                      ;MERRY CHRISTMAS---CALL WITH CODE 902
        CALL    CHRISTMAS
        RET

;MAX_CHARACTERS:
;       CALL    IS_POINTER_POINTING         ;CALL WITH CODE 902
;       MOV     A,#64                       ;SELECT "MAXIMUM CHARACTERS" MESSAGE
;       MOV     DPTR,#8D00H
;       MOVX    @DPTR,A
;       MOV     HPOSIT,#254                 ;SET DISPLAY POSITION
;       MOV     VPOSIT,#80
;       CALL    VWAIT
;       CALL    PDIS
;       CALL    PPOSIT
;       SETB    ENPNTR
;       CLR     ONE_FOUR
;       CALL    OUT8C           ;ENABLE POINTER, FOUR BARS VISIBLE
;       RET

INC_LUT_PAGE:                               ;CALL WITH CODE 903
        MOV     A,LPAGE
        CJNE    A,#15,NORMAL
        MOV     LPAGE,#0FFH
NORMAL: INC     LPAGE
        MOV     A,#90H
        ADD     A,LPAGE
        MOV     DPH,A
        MOVX    @DPTR,A
        RET
```

```
COD904:                                     ;DECREMENT LUT PAGE
        DEC     LPAGE
        MOV     A,LPAGE
        CJNE    A,#0FFH,NRMAL
        MOV     LPAGE,#15
NRMAL:
        MOV     A,#90H
        ADD     A,LPAGE
        MOV     DPH,A
        MOVX    @DPTR,A
        RET

COD905:                                     ;LOAD A LINEAR RAMP INTO SELECTED
                                            ;LUT PAGE
        MOV     RSP,#0
        MOV     RSP+1,#0
        MOV     COLOR,#4
        CALL    SETLUT
        CALL    COLORS
        RET

COD906:                                     ;LOAD A 16-STEP RAMP INTO SELECTED
                                            ;LUT PAGE
        MOV     RSP,#0
        MOV     RSP+1,#0
        MOV     COLOR,#4
        CALL    SETSTP
        CALL    COLORS
        RET

COD907:                                     ;SELECT KVI WRAPAROUND
        CALL    IS_POINTER_POINTING
        MOV     A,#32                       ;SELECT KODAK VIDEO IMAGING
        MOV     DPTR,#8D00H
        MOVX    @DPTR,A
        MOV     HPOSIT,#254                 ;SET DISPLAY POSITION
        MOV     VPOSIT,#128
        SETB    ENPNTR
        SETB    ONE_FOUR
        CALL    OUT8C               ;ENABLE POINTER, ONE BAR VISIBLE
WRAP:
        CALL    PPOSIT
        CALL    VWAIT
        CALL    VWAIT
        INC     HPOSIT
        MOV     A,HPOSIT
        CJNE    A,#0,OTHERCK
        INC     VPOSIT
        JMP     OUTCK
OTHERCK:
        MOV     A,HPOSIT
        CJNE    A,#47,OUTCK
        DEC     VPOSIT
OUTCK:  CALL    KEY_DOWN_TEST
        JNB     CY,WRAP
        RET

COD908:                                     ;SELECT KVI BOUNCE
        CALL    IS_POINTER_POINTING
        MOV     A,#32                       ;SELECT KODAK VIDEO IMAGING
        MOV     DPTR,#8D00H
        MOVX    @DPTR,A
        MOV     HPOSIT,#254                 ;SET DISPLAY POSITION
        MOV     VPOSIT,#128
        SETB    ONE_FOUR
        SETB    PLUS_MINUS
        SETB    ENPNTR
        SETB    ONE_FOUR
        CALL    OUT8C               ;ENABLE POINTER, ONE BAR VISIBLE
```

```
WRAPD:
        CALL    CHANGEPLACE
        JNB     PLUS_MINUS,HCHNG
        INC     VPOSIT
        JMP     HCHNG2
HCHNG:  DEC     VPOSIT
HCHNG2: JNB     ONE_FOUR,PTOUT
        INC     HPOSIT
        JMP     PUTOUT
PTOUT:  DEC     HPOSIT
PUTOUT: MOV     A,HPOSIT
        CJNE    A,#1,OTHRCK
        JNB     ONE_FOUR,OBE
        INC     VPOSIT
        JMP     CKOUT
OBE:    DEC     VPOSIT

OTHRCK:
        MOV     A,HPOSIT
        CJNE    A,#45,CKOUT
        CLR     ONE_FOUR
CKOUT:
        CJNE    A,#210,DIOB
        SETB    ONE_FOUR
DIOB:
        MOV     A,VPOSIT
        CJNE    A,#5,DIOBB
        SETB    PLUS_MINUS
DIOBB:
        CJNE    A,#225,DIOBBB
        CLR     PLUS_MINUS
DIOBBB:
        CALL    KEY_DOWN_TEST
        JNB     CY,HGJ
        RET
HGJ:    JMP     WRAPD

CHANGEPLACE:
        CALL    PPOSIT
        CALL    VWAIT
        CALL    VWAIT
        RET


COD909:
        MOV     COLOR,#4
        CALL    SET_NOMINAL_LUTS
        RET

COD910:
        CALL    COD909
        MOV     COLOR,#3
        MOV     OFFSET,#100                     ;NOMINAL BLUE OFFSET = 80
        CALL    SETLUT_W_SELECTED_OFFSET
        RET


COD911:                                         ;ROTATE THROUGH CORING SETTI
        CALL    CHANGE_CORING
        CALL    SLOAD
        RET


COD912:                                         ;7-BIT LINEAR RAMP IN SELECT
                                                ;LUT PAGE
        MOV     RSP,#0
        MOV     RSP+1,#0
        MOV     COLOR,#4
        CLR     A
        MOV     SKIPCOUNT,#0
        MOV     DPH,RSP
        MOV     DPL,RSP+1
```

```
OUTTORAM:
        MOVX    @DPTR,A
        INC     DPTR
        MOVX    @DPTR,A
        INC     DPTR
        INC     SKIPCOUNT
        INC     SKIPCOUNT
        MOV     A,SKIPCOUNT
        JNZ     OUTTORAM
        CALL    COLORS
        RET


COD913:                                         ;DISPLAY STATUS

        CALL    IS_POINTER_POINTING     ;CALL WITH CODE 902
LETS_SEEIT:
        MOV     A,#128                  ;SELECT "MACHINE STATUS"
        MOV     DPH,#8DH
        MOVX    @DPTR,A
        MOV     HPOSIT,#254             ;SET DISPLAY POSITION
        MOV     VPOSIT,#80
        CALL    VWAIT
        CALL    PDIS
        CALL    PPOSIT
        SETB    ENPNTR
        CLR     ONE_FOUR
        CALL    OUT8C           ;ENABLE POINTER, FOUR BARS VISIBLE
        MOV     SKIPCOUNT,#128
COUNTEM:
        CALL    VWAIT
        DJNZ    SKIPCOUNT,COUNTEM
        MOV     A,#192
        MOV     DPH,#8DH
        MOVX    @DPTR,A
        MOV     SKIPCOUNT,#128
SOONEND:
        CALL    VWAIT
        DJNZ    SKIPCOUNT,SOONEND
        CALL    PDIS
        CALL    SCAN_NOW
        RET


COD914:
        CALL    GET_CORNER_PIXELS
GOTCPIX:
        RET


COD915:
        MOV     CCA_FUNCTION,#00001111B         ;SET FOR MAX VIDEO,GREEN
                                                ;MIDDLE VALUES OF COLUMN 5
        CALL    GET_MIDCOLUMN_DATA
        RET


COD916:
        MOV     CCA_FUNCTION,#00001101B         ;SET FOR MIN VIDEO,GREEN
                                                ;MIDDLE VALUES OF COLUMN 5
        CALL    GET_MIDCOLUMN_DATA
        RET


COD917:                                         ;KVI ON BLUE
KVI_ON_BLUE:
        MOV     LPAGE,#15
        MOV     COLOR,#3
        CALL    LOAD_ONECOLOR_LUTS
        CALL    KVI
        RET
```

```
COD918:
        CALL    COLORBAR
        RET

COD919:
POINTER_MEM_SCROLL:
        CALL    KVI_ON_BLUE
        MOV     B,#240
OOP:
        MOV     A,#16
        ADD     A,B
        MOV     B,A
        MOV     SKIPCOUNT,#60
        MOV     DPTR,#8D00H
        MOVX    @DPTR,A
OOOP:
        CALL    VWAIT
        DJNZ    SKIPCOUNT,OOOP
        CALL    KEY_DOWN_TEST
        JNB     CY,OOP
        RET

COD920:
        CALL    COD926
        CALL    THREEWAIT
        CALL    COD925
        CALL    THREEWAIT
        CALL    COD924
        CALL    THREEWAIT
        CALL    COD923
        CALL    THREEWAIT
        CALL    COD922
        CALL    THREEWAIT
        CALL    COD921
        CALL    THREEWAIT
        CALL    COD922
        CALL    THREEWAIT
        CALL    COD923
        CALL    THREEWAIT
        CALL    COD924
        CALL    THREEWAIT
        CALL    COD925
        CALL    THREEWAIT
CANWESTOP:
        CALL    KEY_DOWN_TEST
        JNB     CY,COD920
        RET
THREEWAIT:
        RET

COD921:
        MOV     POSTER_MASK,#10000000B
        MOV     OFFSET,#64
        JMP     MASK_SET
COD922:
        MOV     POSTER_MASK,#11000000B
        MOV     OFFSET,#32
        JMP     MASK_SET
COD923:
        MOV     POSTER_MASK,#11100000B
        MOV     OFFSET,#16
        JMP     MASK_SET
COD924:
```

```
        MOV     POSTER_MASK,#11110000B
        MOV     OFFSET,#8
        JMP     MASK_SET
COD925:
        MOV     POSTER_MASK,#11111000B
        MOV     OFFSET,#4
        JMP     MASK_SET
COD926:
        MOV     POSTER_MASK,#11111100B
        MOV     OFFSET,#2
        JMP     MASK_SET
COD927:
        MOV     POSTER_MASK,#11111110B
        MOV     OFFSET,#1
        JMP     MASK_SET
COD928:
        MOV     POSTER_MASK,#11111111B
        MOV     OFFSET,#0
MASK_SET:
        MOV     COLOR,#3
        CALL    SETLUT_W_SELECTED_OFFSET
        MOV     COLOR,#2
        CALL    SETLUT_W_SELECTED_OFFSET
        MOV     COLOR,#1
        CALL    SETLUT_W_SELECTED_OFFSET
        RET


COD929:                                         ;POS
        MOV     COLOR,#4
        SETB    POS_NEG
        CALL    SET_NOMINAL_LUTS
        RET

COD930:                                         ;NEG
        MOV     COLOR,#4
        CLR     POS_NEG
        CALL    SET_NOMINAL_LUTS
        RET


COD931:                                 ;ALL ZERO COEFFICIENTS IN MATRIX
        MOV     DPTR,#SERIAL_REGISTERS
        MOV     A,#00
        MOVX    @DPTR,A
        INC     DPTR
        MOVX    @DPTR,A
        INC     DPTR
        MOVX    @DPTR,A
        INC     DPTR
        MOVX    @DPTR,A
        INC     DPTR
        MOVX    @DPTR,A
        INC     DPTR
        MOVX    @DPTR,A
        CALL    SLOAD
        RET

COD932:
        CALL    LARRYBAR
        RET

COD933:
```

```
        CALL    FADE_OUT
        RET

COD934:
        MOV     DPTR,#ROTATION_POINT
        MOVX    A,@DPTR
        CLR     C
        ADDC    A,#8
        JNC     MOVITBACK
        MOV     A,#255
MOVITBACK:
        MOVX    @DPTR,A
        RET

COD935:
        MOV     DPTR,#ROTATION_POINT
        MOVX    A,@DPTR
        CLR     C
        SUBB    A,#8
        JNC     MOVITBACK
        MOV     A,#0
        JMP     MOVITBACK

COD936:
COD937:
COD938:
COD939:
COD940:
COD941:
COD942:
COD943:
COD944:
COD945:
COD946:
COD947:
COD948:
COD949:
COD950:
COD951:
COD952:
        RET

MBRITE:
        DEC     BRITE_STATUS
        CLR     PLUS_MINUS
        JMP     BRITE_CHANGE
PBRITE:
        INC     BRITE_STATUS
        SETB    PLUS_MINUS
BRITE_CHANGE:
        MOV     COLOR,#0
        CALL    IS_POINTER_POINTING
        MOV     LINE_MARKER,#128        ;SELECT BRIGHTNESS
        MOV     HPOSIT,#254             ;SET DISPLAY POSITION
        MOV     VPOSIT,#48
        CALL    VWAIT
        CALL    PDIS
        CALL    PPOSIT
        MOV     HPOSIT,BRITE_STATUS
        SETB    ONE_FOUR
        CALL    STATUS_DISPLAY
        JNB     PLUS_MINUS,DIM
        CALL    APEROP
        JMP     OKDOKE
DIM:    CALL    APERCL
OKDOKE: CALL    STATUS_CHANGE
        RET
```

```
MSAT:
        DEC     SAT_STATUS
        CLR     PLUS_MINUS
        JMP     SAT_CHANGE
PSAT:
        INC     SAT_STATUS
        SETB    PLUS_MINUS
SAT_CHANGE:
        MOV     COLOR,#0
        MOV     A,SAT_STATUS            ;22=UNITY
        CJNE    A,#14,ONWITHIT
        MOV     SAT_STATUS,#15          ;DESATURATION STOP
        JMP     NCHDIS
ONWITHIT:
        CJNE    A,#33,CHANGE_NOW        ;OVERSATUATION STOP
        MOV     SAT_STATUS,#32
NCHDIS: MOV     LINE_MARKER,#160        ;USE LINE_MARKER AS A MARKER FOR
                                        ;PORTION OF POINTER MEMORY DISPLAYED
                                        ;(IN THIS CASE, SELECT SATURATION)
        MOV     HPOSIT,#254             ;SET DISPLAY POSITION
        MOV     VPOSIT,#48
        CALL    VWAIT
        CALL    PDIS
        CALL    PPOSIT
        MOV     HPOSIT,SAT_STATUS
        SETB    ONE_FOUR
        CALL    STATUS_DISPLAY
        JMP     NO_CHANGE
CHANGE_NOW:
        CALL    IS_POINTER_POINTING
        MOV     LINE_MARKER,#160        ;USE LINE_MARKER AS A MARKER FOR
                                        ;PORTION OF POINTER MEMORY DISPLAYED
                                        ;(IN THIS CASE, SELECT SATURATION)
        MOV     HPOSIT,#254             ;SET DISPLAY POSITION
        MOV     VPOSIT,#48
        CALL    VWAIT
        CALL    PDIS
        CALL    PPOSIT
        MOV     HPOSIT,SAT_STATUS
        SETB    ONE_FOUR
        CALL    STATUS_DISPLAY
        CALL    CHANGE_MATRIX
        CALL    SLOAD
        CALL    STATUS_CHANGE
        RET


IS_POINTER_POINTING:
;this routine is only used on the alpha model----it makes the micro aware
;of whether the pointer is pointing or displaying status info---beta
;clocking schemes (gated pclock runs constantly) should make this
;unnecessary
        MOV     A,LINE_MARKER
        CLR     C
        ADDC    A,#224
        JC      BYEBYE
        CALL    VWAIT
        CALL    PDIS
        MOV     HPOSIT,#254
        CALL    PPOSIT
        CALL    VWAIT
BYEBYE: RET


STATUS_DISPLAY:
        CLR     C                       ;STOPS TO PREVENT BAR WRAPAROUND
        MOV     A,#224
        ADDC    A,HPOSIT
        JC      BYE
        ADDC    A,#20
        JNC     BYE
```

```
        MOV     A,LINE_MARKER           ;SELECT DIPLAYED PORTION OF POINTER
        JB      ONE_FOUR,UNODIS                 ;MEMORY
        MOV     A,#192
UNODIS: MOV     DPTR,#8D00H
        MOVX    @DPTR,A
                                        ;ENABLE POINTER
        SETB    ENPNTR
        CALL    OUT8C
UNOBAR: MOV     A,LINE_MARKER
        ADD -   A,#9
        MOV     VPOSIT,A
        CALL    TO25
BYE:    RET


COLOR_STATUS_CHANGE:
        CALL    CHANGE_OFFSETS
        CALL    SLOAD
STATUS_CHANGE:
        CALL    LOAD_BAR
        MOV     TL0,#128                ;SETS NUMBER OF VINDEXES UNTIL
                                        ;COUNTER ROLOVER
        CALL    VCOUNT
        CALL    SCAN_NOW
        RET


;this code is not used in this version
;       MOV     A,LINE_MARKER           ;RESELECT DISPLAYED PORTION
;       JB      ONE_FOUR,UNONEW
;       MOV     A,#192
;UNONEW:        MOV     DPTR,#8D00H
;       MOVX    @DPTR,A
;                                       ;ENABLE POINTER
;       SETB    ENPNTR
;       CALL    OUT8C
;UNOOUT:RET


MCONT:
        DEC     CONT_STATUS
        CLR     PLUS_MINUS
        JMP     CONT_CHANGE
PCONT:
        INC     CONT_STATUS
        SETB    PLUS_MINUS
CONT_CHANGE:
        MOV     COLOR,#0
        CALL    IS_POINTER_POINTING
        MOV     LINE_MARKER,#144        ;SELECT CONTRAST
        MOV     HPOSIT,#254             ;SET DISPLAY POSITION
        MOV     VPOSIT,#48
        CALL    VWAIT
        CALL    PDIS
        CALL    PPOSIT
        MOV     HPOSIT,CONT_STATUS
        SETB    ONE_FOUR


CONTRAST_STATUS_DISPLAY:
        CLR     C                       ;STOPS TO PREVENT BAR WRAPAROUND
        MOV     A,#224
        ADDC    A,HPOSIT
        JC      BYE
        ADDC    A,#20
        JNC     BYE
        MOV     A,LINE_MARKER           ;SELECT DIPLAYED PORTION OF POINTER
                                        ;MEMORY
        MOV     DPTR,#8D00H
        MOVX    @DPTR,A
```

```
                                        ;ENABLE POINTER
        SETB    ENPNTR
        CALL    OUT8C
        MOV     A,LINE_MARKER
        ADD     A,#9
        MOV     VPOSIT,A
        MOV     RSP,#00
        MOV     RSP+1,#00
        CALL    CALC_N_MOVE
        MOV     RSP,#00
        MOV     RSP+1,#00
        CALL    CHANGE_CONTRAST
        CALL    VWAIT
        MOV     COLOR,#3
ONCE_AGAIN:
        MOV     RSP,#00
        MOV     RSP+1,#00
        CALL    LDLUT
        DJNZ    COLOR,ONCE_AGAIN
        CALL    STATUS_CHANGE
        RET

MSHARP:
        DEC     SHARP_STATUS
        CLR     PLUS_MINUS
        JMP     SHARP_CHANGE
PSHARP:
        INC     SHARP_STATUS
        SETB    PLUS_MINUS
SHARP_CHANGE:
        MOV     COLOR,#0
        MOV     A,SHARP_STATUS          ;22=UNITY
        CJNE    A,#19,OKEYDOKEY
        MOV     SHARP_STATUS,#20        ;NO ENHANCEMENT STOP
        JMP     NCDIS
OKEYDOKEY:
        CJNE    A,#28,CHSHARP           ;MAXIMUM ENHANCEMENT STOP
        MOV     SHARP_STATUS,#27
NCDIS:  MOV     LINE_MARKER,#176        ;SELECT SHARPNESS
        MOV     HPOSIT,#254             ;SET DISPLAY POSITION
        MOV     VPOSIT,#48
        CALL    VWAIT
        CALL    PDIS
        CALL    PPOSIT
        MOV     HPOSIT,SHARP_STATUS
        SETB    ONE_FOUR
        CALL    STATUS_DISPLAY
NO_CHANGE:
        MOV     TL0,#128                ;SETS NUMBER OF VINDEXES UNTIL
                                        ;COUNTER ROLOVER
        CALL    VCOUNT
        RET
CHSHARP:
        CALL    IS_POINTER_POINTING
        MOV     LINE_MARKER,#176        ;SELECT SHARPNESS
        MOV     HPOSIT,#254             ;SET DISPLAY POSITION
        MOV     VPOSIT,#48
        CALL    VWAIT
        CALL    PDIS
        CALL    PPOSIT
        MOV     HPOSIT,SHARP_STATUS
        SETB    ONE_FOUR
        CALL    STATUS_DISPLAY
        CALL    CHANGE_EDGE_ENHANCEMENT
        CALL    SLOAD
        CALL    STATUS_CHANGE
        RET


MRED:
        DEC     RED_STATUS
        CLR     PLUS_MINUS
        JMP     RED_CHANGE
```

```
PRED:
        INC     RED_STATUS
        SETB    PLUS_MINUS
RED_CHANGE:
        MOV     COLOR,#2
        CALL    IS_POINTER_POINTING
        MOV     LINE_MARKER,#208        ;SELECT RED
        MOV     HPOSIT,#254             ;SET DISPLAY POSITION
        MOV     VPOSIT,#80
        CALL    VWAIT
        CALL    PDIS
        CALL    PPOSIT
        MOV     HPOSIT,RED_STATUS
        CLR     ONE_FOUR
        CALL    STATUS_DISPLAY
        CALL    COLOR_STATUS_CHANGE
        RET

MGREEN:
        DEC     GREEN_STATUS
        CLR     PLUS_MINUS
        JMP     GREEN_CHANGE
PGREEN:
        INC     GREEN_STATUS
        SETB    PLUS_MINUS
GREEN_CHANGE:
        MOV     COLOR,#1
        CALL    IS_POINTER_POINTING
        MOV     LINE_MARKER,#224        ;SELECT GREEN
        MOV     HPOSIT,#254             ;SET DISPLAY POSITION
        MOV     VPOSIT,#80
        CALL    VWAIT
        CALL    PDIS
        CALL    PPOSIT
        MOV     HPOSIT,GREEN_STATUS
        CLR     ONE_FOUR
        CALL    STATUS_DISPLAY
        CALL    COLOR_STATUS_CHANGE
        RET

MBLUE:
        DEC     BLUE_STATUS
        CLR     PLUS_MINUS
        JMP     BLUE_CHANGE
PBLUE:
        INC     BLUE_STATUS
        SETB    PLUS_MINUS
BLUE_CHANGE:
        MOV     COLOR,#3
        CALL    IS_POINTER_POINTING
        MOV     LINE_MARKER,#240        ;SELECT BLUE
        MOV     HPOSIT,#254             ;SET DISPLAY POSITION
        MOV     VPOSIT,#80
        CALL    VWAIT
        CALL    PDIS
        CALL    PPOSIT
        MOV     HPOSIT,BLUE_STATUS
        CLR     ONE_FOUR
        CALL    STATUS_DISPLAY
        CALL    COLOR_STATUS_CHANGE
        RET

ABRITE: RET
ACOLOR: RET

CKEGE:  MOV     A,HPOSIT
        CLR     C
        ADDC    A,#34
        JNC     CKREGE
        CLR     A                       ;POINT LEFT,POINTER IS AT LEFT EDGE
        MOV     DPTR,#8D00H
        MOVX    @DPTR,A
```

```
OKAY:
        RET
CKREGE: ADDC    A,#188
        JC      OKAY
        MOV     A,#16                   ;POINT RIGHT,POINTER IS AT RIGHT EDGE
        MOV     DPTR,#8D00H
        MOVX    @DPTR,A
        JMP     OKAY


PRIGHT:
        DEC     HPOSIT
        MOV     A,HPOSIT
        CJNE    A,#0,NEXT1              ;255 POSITION CAUSES WRAPAROUND
        INC     HPOSIT
        RET
NEXT1:  CALL    PMOVE
        MOV     A,#16                   ;POINT RIGHT
        MOV     DPTR,#8D00H
        MOVX    @DPTR,A
        CALL    CKEGE
        CALL    KEY_SCAN
        JB      CY,PRIGHT
        RET

PLEFT:
        INC     HPOSIT
        MOV     A,HPOSIT
        CJNE    A,#255,NEXT2
        DEC     HPOSIT
        RET
NEXT2:  CALL    PMOVE
        CLR     A                       ;POINT LEFT
        MOV     DPTR,#8D00H
        MOVX    @DPTR,A
        CALL    CKEGE
        CALL    KEY_SCAN
        JB      CY,PLEFT
        RET

PDOWN:  DEC     VPOSIT
        MOV     A,VPOSIT
        CJNE    A,#5,NEXT3
        INC     VPOSIT
        RET
NEXT3:  CALL    PMOVE
        CALL    KEY_SCAN
        JB      CY,PDOWN
        RET

PUP:    INC     VPOSIT
        MOV     A,VPOSIT
        CJNE    A,#230,NEXT4            ;PREVENTS VERTICAL WRAPAROUND
        DEC     VPOSIT
        RET
NEXT4:  CALL    PMOVE
        CALL    KEY_SCAN
        JB      CY,PUP
        RET


PDOWN_LEFT:
        INC     HPOSIT
        MOV     A,HPOSIT
        CJNE    A,#255,UR
        DEC     HPOSIT
UR:     DEC     VPOSIT
        MOV     A,VPOSIT
```

```
        CJNE    A,#5,NEXT5
        INC     VPOSIT
NEXT5:  CALL    PMOVE
        CLR     A                       ;POINT LEFT
        MOV     DPTR,#8D00H
        MOVX    @DPTR,A
        CALL    CKEGE
        CALL    KEY_SCAN
        JB      CY,PDOWN_LEFT
        RET

PDOWN_RIGHT:
        MOV     A,#16                   ;POINT RIGHT
        MOV     DPTR,#8D00H
        MOVX    @DPTR,A
        DEC     HPOSIT
        MOV     A,HPOSIT
        CJNE    A,#255,UL
        INC     HPOSIT
UL:     DEC     VPOSIT
        MOV     A,VPOSIT
        CJNE    A,#5,NEXT6
        INC     VPOSIT
NEXT6:  CALL    PMOVE
        MOV     A,#16                   ;POINT RIGHT
        MOV     DPTR,#8D00H
        MOVX    @DPTR,A
        CALL    CKEGE
        CALL    KEY_SCAN
        JB      CY,PDOWN_RIGHT
        RET

PUP_LEFT:
        INC     HPOSIT
        MOV     A,HPOSIT
        CJNE    A,#255,DR
        DEC     HPOSIT
DR:     INC     VPOSIT
        MOV     A,VPOSIT
        CJNE    A,#230,NEXT7
        DEC     VPOSIT
NEXT7:  CALL    PMOVE
        CLR     A                       ;POINT LEFT
        MOV     DPTR,#8D00H
        MOVX    @DPTR,A
        CALL    CKEGE
        CALL    KEY_SCAN
        JB      CY,PUP_LEFT
        RET

PUP_RIGHT:
        DEC     HPOSIT
        MOV     A,HPOSIT
        CJNE    A,#255,DL
        INC     HPOSIT
DL:     INC     VPOSIT
        MOV     A,VPOSIT
        CJNE    A,#230,NEXT8
        DEC     VPOSIT
NEXT8:  CALL    PMOVE
        MOV     A,#16                   ;POINT RIGHT
        MOV     DPTR,#8D00H
        MOVX    @DPTR,A
        CALL    CKEGE
        CALL    KEY_SCAN
        JB      CY,PUP_RIGHT
        RET
```

```
PMOVE:
        CALL    VWAIT
        CALL    PPOSIT
        RET

PEN:
        CLR     VMARK
        MOV     LINE_MARKER,#0
        MOV     HPOSIT,#128             ;POINTER IN CENTER
        MOV     VPOSIT,#128
        CALL    VWAIT
        CALL    PDIS
        CLR     A                       ;POINT LEFT
        MOV     DPTR,#8D00H
        MOVX    @DPTR,A
        CALL    PPOSIT
        CALL    VWAIT
        CALL    VWAIT
        SETB    ENPNTR
        SETB    ONE_FOUR
        CALL    OUT8C           ;ENABLE POINTER, ONE BAR.VISIBLE
        RET

PDIS:
        CLR     VMARK
        CLR     ENPNTR
        CALL    OUT8C
        RET

TO25:
        MOV     SKIPCOUNT,#10
LOOP20:
        CALL    VWAIT
        DJNZ    SKIPCOUNT,LOOP20
        RET

VCOUNT:
        MOV     TMOD,#00000110B
        SETB    TR0
        CLR     VMARK
        SETB    EA
        SETB    ET0
        RET

SCAN_NOW:
        SETB    SCAN_B
        CLR     CRSR_B
        CALL    DISPLY
        RET
        END
```

What is claimed is:

1. A graphics generator for use in a video display system, said video display system including a video monitor and means for applying a video signal to said video monitor to provide a video picture on said video monitor, said graphics generator comprising:

video timing means for providing a line rate clock signal and a pixel rate clock signal to synchronize said video signal for display on said video monitor;

a microprocessor configured to provide digital data representative of graphical icons for display on said video monitor, a memory load clock signal of slower frequency than said pixel rate clock signal, and position data indicating the line and pixel on said video monitor at which selected ones of the graphical icons are to be displayed;

graphics memory means for selectively writing in, storing, and reading out said digital data;

graphics positioning means operating in synchronism with said line rate and pixel rate clock signals for generating an actuating signal at a time determined by said position data;

addressing means responsive to said microprocessor for generating write addresses to address said graphics memory means and write said digital data serially into said graphics memory means bit-by-bit in synchronism with said load clock signal, said addressing means further responsive to both said microprocessor and said actuating signal for generating read addresses to address said graphics memory means and read said digital data serially out of said graphics memory means bit-by-bit in synchronism with said pixel rate clock signal;

means for providing a graphics signal to display a selected color on said video monitor; and means responsive to the digital data read from said graphics memory means for selecting said video signal or said graphics signal for display on said video monitor.

2. Apparatus in accordance with claim 1 wherein said addressing means comprises:

a digital counter connected to said graphics memory means for generating addressing data to provide said read and write addresses; and control means connected to said microprocessor, said digital counter, and said video timing means for selecting said load clock signal or said pixel clock signal to clock said digital counter.

3. Apparatus in accordance with claim 2 wherein said addressing means further comprises a multiplexer responsive to said microprocessor for selecting address data from both said microprocessor and said digital counter to provide said read and write addresses.

4. Apparatus in accordance with claim 1 wherein said graphics memory means comprises a digital memory circuit.

5. Apparatus in accordance with claim 1 wherein said graphics positioning means comprises:

a first digital counter loadable with the line position data provided by said microprocessor and connected to said video timing means so as to be clocked by said line rate clock signal; and a second digital counter loadable with the pixel position data provided by said microprocessor and connected to said video timing means so as to be clocked by said pixel rate clock signal.

6. Apparatus in accordance with claim 5 wherein said graphics positioning means further comprises a logical AND gate connected to its inputs to said first and second digital counters and at its output to said addressing means for providing said actuating signal to said addressing means.

7. Apparatus in accordance with claim 1 and further including a digital memory connected to said microprocessor for assembling graphics data prior to writing said graphics data into said graphics memory means.

8. Apparatus in accordance with claim 1 wherein said selecting means comprises:

a multiplexer;

means for applying said video and graphics signals to the selectable inputs of said multiplexer; and means for applying said digital data to the control input of said multiplexer.

9. Apparatus in accordance with claim 1 wherein said video display system further includes cursor controller means for indicating the desired position of a cursor icon on said video monitor, said microprocessor being responsive to said cursor controller for calculating said position data.

10. Apparatus in accordance with claim 1 wherein said video display system further includes means for controlling selected characteristics of said video signal, said microprocessor being responsive to said characteristics of said video signal for providing said digital data to said graphics memory means.

* * * * *